US007784338B2

(12) United States Patent
Estes

(10) Patent No.: US 7,784,338 B2
(45) Date of Patent: Aug. 31, 2010

(54) LOW MASS SENSOR FOR FREE POINT TOOL

(75) Inventor: James D. Estes, 6010 Englishoak Dr., Arlington, TX (US) 76016

(73) Assignees: Titan Specialties, Ltd., Pampa, TX (US), part interest; James D. Estes, Arlington, TX (US), part interest ( * ) Notice: Subject to any disclaimer, the term of this patent is extended or adjusted under 35 U.S.C. 154(b) by 321 days.

(21) Appl. No.: 11/975,048

(22) Filed: Oct. 17, 2007

(65) Prior Publication Data

US 2008/0034857 A1 Feb. 14, 2008

Related U.S. Application Data

(62) Division of application No. 11/033,234, filed on Jan. 11, 2005, now Pat. No. 7,302,841.

(51) Int. Cl.
*E21B 47/00* (2006.01)

(52) U.S. Cl. ..... 73/152.56

(58) Field of Classification Search ..... None
See application file for complete search history.

(56) References Cited

U.S. PATENT DOCUMENTS

| | | | | |
|---|---|---|---|---|
| 3,019,841 | A * | 2/1962 | Ternow | 175/4.51 |
| 6,414,482 | B1 * | 7/2002 | Mase | 324/207.2 |
| 2003/0024702 | A1 * | 2/2003 | Gray et al. | 166/301 |
| 2006/0086191 | A1 * | 4/2006 | Morelli et al. | 73/779 |

* cited by examiner

*Primary Examiner*—Robert R Raevis
(74) *Attorney, Agent, or Firm*—Whitaker, Chalk, Swindle & Sawyer, LLP; Stephen S. Mosher

(57) ABSTRACT

A free point tool comprises an elongated main shaft assembly and a low mass sensor assembly coaxially and slidingly disposed over the elongated main shaft. The low mass sensor assembly is adapted to be supported within the down hole casing by first and second drag spring centralizers coupled respectively to upper and lower ends of the low mass sensor assembly. The low mass sensor assembly comprises a magnetic amplifier sensor disposed in a sensor body and having a variable inductance proportionally responsive to longitudinal and rotational displacement of an adjacent sensor plate portion of a movable sensor sleeve concentric with and enclosing the sensor body, wherein the sensor sleeve is attached to the first drag spring centralizer and the sensor body is attached to the second drag spring centralizer.

9 Claims, 13 Drawing Sheets

Vmax
Vcen
Vqui
-Vqui
-Vcen
-Vmax
438
434
440
432
430
450
452
454
458
460
428
Vquiescent
-Vquiescent
t0
t1
t2
tp1
t3
t4
tp2 t0
t1
t2
tp
468
Vmax
Vcen
Vmin
478
476
474
480
472
470
Vq+
Vmin ≈ VQ
ΔV=Vmax -Vmin
ΔV α ΔLS
ΔLS α Δ DISPLACEMENT 482
484
486
492
-Vmin
-Vcen
-Vmax
488
490
Vq-
tp1
t3
t4
tp2

LOW MASS SENSOR FOR FREE POINT TOOL

CROSS REFERENCE TO RELATED APPLICATION

The present application is a Divisional of U.S. patent application Ser. No. 11/033,234, filed Jan. 11, 2005 now U.S. Pat. No. 7,302,841 and entitled "Free Point Tool With Low Mass Sensor."

BACKGROUND OF THE INVENTION

1. Field of the Invention

The present invention generally relates to down-hole tools for use in oil and gas well holes and, more particularly, down-hole tools used to locate the position of a stuck point of a drill pipe string in the well hole.

2. Background and Description of the Prior Art

During well drilling operations in the oil and gas well drilling industry, the drill string often becomes stuck in the well. Free point tools have long been used to locate the stuck point of the drill string in the well, so that the drill pipe above the stuck point that is not stuck—i.e., "free"—can be removed to permit further operations to loosen the stuck pipe.

Generally, a free point tool includes a lower portion and an upper portion. When installed within a well casing in a well, the upper and lower portions of a free point tool are configured to detect relative movement of one portion of the tool with respect to the other portion. Traditionally, three basic types of free point tools have been employed. The "magnetic" type utilizes electromagnets to attach the free point tool to the well casing at a portion of the well casing believed to include the stuck point. One example of such a tool is disclosed in U.S. Pat. No. 2,530,309 issued to P. W. Martin for a "Device For Determining Relative Movements Of Parts In Wells." The "mechanical arm" type causes arms or extensions operated by a mechanical or electrical device to engage the inner surface of the well casing to support the free point tool in the desired position. An example of this type is disclosed in U.S. Pat. No. 5,520,245 issued to James D. Estes, the applicant of the present application, for a "Device To Determine Free Point."

The third type of free point tool, called the "spring type," employs two sets of bowed leaf springs, called drag springs, one set associated with an upper portion of the tool and another set associated with a lower portion of the tool, to support the free point tool in the well casing. Typically, three bow springs are used in each set, disposed at 120 degree intervals around the body of the free point tool. An example of the third type is disclosed in U.S. Pat. No. 3,004,427 issued to T. L. Berry for a "Free Point Indicator For Determining The Point At Which Stuck Pipe Is Free In A Well."

Free point tools are complex devices that must operate in extremely harsh environments where they are subject to wide temperature variations, high pressures, corrosive substances, and the like. Yet, in such conditions, the tool must provide sensitive, reliable measurements of the displacement of the free portion of a well pipe when a tension or torque is applied to the pipe string to cause the displacement. The spring type free point tool has enjoyed substantial commercial success over the years because of it relative simplicity and reliability. However, there are a number of well-known problems with its use.

The drag springs of an exemplary free point tool such as disclosed in the '427 patent must support the entire free point tool assembly—about 39 pounds, including the free point tool (24 lb.), one-half of the slack joint (5 lb.) and the shot rod (10 lb.). To support the tool assembly without slipping, the springs must be set to support nearly twice the weight of the assembly. But this type tool requires extra weight in the form of sinker bars to be added to the weight of the tool assembly, plus the other half of the slack joint, to cause the tool to pass down the well casing easily. In the illustrative prior art free point tool, three sinker bars, at thirty pounds each, are used. The extra weight of these sinker bars is thus about 90 pounds. With each set of drag springs set for about twenty pounds, which is about the maximum that can be effectively used in a well casing environment, the ratio of the weight capacity of the springs (40 lb) to the weight to be supported (39 lb) is approximately one-to-one, making the adjustment of the drag springs relatively critical. If the tension in the drag springs is too high, the tool will not slide down the casing. If the tension is too little, the drag springs will not support the tool and the measurement will not be repeatable. Associated with the critical spring tension adjustment is the high degree of uncertainty that the drag springs will have the correct holding power and that an accurate measurement is made at each desired point in the well casing. Frequently, this uncertainty and the occasional slippage of the springs along the well casing requires that the tool be hauled up, the drag springs reset, and the measurement attempted again.

The sensor assembly in the exemplary prior art tool consists of a variable inductance that must be set electrically to a specified point after the tool has been positioned for taking a measurement. To perform this "reset" the tool must be moved down within the well casing two feet to close the sensor elements, so that the gap between two halves of the variable inductance core is reduced to its minimum value to ensure a repeatable stretch (tension on the drill pipe) measurement. Then, the tool must be raised one foot to center the slack joint. For torque measurements (application of a right hand torque to the well casing), the inductor is energized with a positive voltage to zero the sensor. Further, a predetermined amount of friction is built in to the variable inductance components so that the setting will be retained after the electrical signal that sets the sensor in position is disconnected prior to taking the measurement. To make the measurement, this friction must be overcome, a factor which affects the accuracy of the measurement. Moreover, this variable inductance varies non-linearly with the displacement of the well casing during the measurement. This characteristic limits the usable sensitivity within a relatively narrow range. Further, in order to ensure adequate repeatability to the measurements, the components of the sensor must be enclosed within a pressure capsule that is filled with oil and equipped with a mechanism to equalize the pressure within the capsule to that within the well casing. Oil seals are required to prevent loss of oil or contamination of the sensor by other fluids in the well casing. The complexity of this sensor design adds weight, reduces reliability and adds to the maintenance expense. The added weight exacerbates the drag spring problems described herein above.

The exemplary prior art spring type of free point tool described above further includes a CCL unit. The CCL unit is a casing collar locator assembly that includes a CCL triggering circuit for igniting a detonating cap that in turn fires the associated string shot explosive to loosen the casing collar joint between the free pipe and the stuck pipe after the stuck point is located. The CCL triggering circuit, which will be called a "CCL" in the description to follow, must have an isolation circuit built in to prevent firing of the detonating cap during a measurement. Typically, this circuit is provided by semiconductor diodes, which limit the effectiveness of the circuit to about 350 degrees Fahrenheit (350 F.) because the diodes lose their blocking characteristics above that temperature. Moreover, the shunting effect of the diodes also affects the free point sensor signal if the same wire is used for both functions. Unfortunately, down-hole temperatures become higher as the depth of the well increases, a circumstance that is more prevalent currently as well drilling extends to deeper levels to access more remote deposits of oil or gas.

One other component of the prior art free point tool described above is a slack joint, which is a sliding joint in the free point tool assembly. This slack joint mechanically decouples the free point tool itself from the entire assembly lowered down the well casing when the desired measurement point is reached. At that point, the free point tool is supported by the drag springs, while the rest of the assembly—the sinker bars—is supported by the wire line cable. The slack joint partially adds to the weight that must be supported by the drag springs.

What is needed is a free point tool that overcomes the problems and disadvantages described herein above. It will be appreciated that the weight of the prior art free point tool that must be supported by the drag springs is a major source of the problems with its use. Further, the prior art sensor design has relatively poor sensitivity, a narrow range of linearity, requires substantial maintenance, requires force to overcome the built-in friction, and requires a relatively complex procedure to reset it for a measurement. Moreover, the prior art tool is ineffective at temperatures above 350 F.

SUMMARY OF THE INVENTION

Attacking the weight issue first, it was realized that if most of the weight of the entire free point tool assembly could be supported by the wire line, and a sensor design could be devised that was very light, of simple construction, would operate at higher temperatures, and had superior sensitivity and linearity, a substantial improvement would be realized in the utility of the spring type free point tool. The breakthrough occurred when it was realized that a magnetic amplifier principle applied to the sensor itself could provide the linearity and sensitivity, simplicity, ruggedness and light weight that would be needed. The resulting design yielded a low mass sensor assembly that weighs less than five pounds, including the entire sensor structure and the drag springs. The drag springs may be set to approximately ten pounds of tension each, which results in a spring capacity to sensor assembly weight of at least four-to-one. This ratio, which is four times greater than the prior art free point tool described herein above because of the much lower mass of the low mass sensor assembly disclosed herein below, results in much less uncertainty in the drag spring holding power, resulting in reliable measurements that usually only have to be made once. Moreover, the entire tool weight, including the low mass sensor assembly, is approximately 36 pounds, which provides sufficient margin above the tension setting of the drag springs to lower it down hole without sinker bars. Many other advantages will become apparent upon understanding the invention described in the detailed description and accompanying drawings that follow.

Accordingly there is disclosed a low mass sensor assembly for a free point tool used to locate a free point of a well casing, comprising: a magnetic amplifier assembly having a first part and a second part; a sensor body having a tubular shape, wherein the first part of the magnetic amplifier assembly is disposed proximate and within an outer surface of a first portion of the sensor body; and a sensor sleeve having a tubular shape and configured for concentrically and freely receiving the sensor body therewithin, wherein the second part of the magnetic amplifier forms a first portion of the sensor sleeve in juxtaposition with the first portion of the sensor body.

In another aspect, there is disclosed a free point tool, comprising: an elongated main shaft assembly having a longitudinal axis for being suspended within a well casing at a lower end of a wire line cable; and a low mass sensor assembly coaxially disposed over the elongated main shaft and adapted to slide freely along the elongated main shaft and to be supported within the well casing by first and second drag spring centralizers coupled respectively to first and second portions of the low mass sensor assembly.

In another aspect of the free point tool of the present disclosure the first and second drag spring centralizers support only the low mass sensor assembly and the first and second drag spring centralizers coupled thereto, when the free point tool is positioned for measuring.

In yet another aspect of the free point tool of the present disclosure the ratio of total drag spring capacity to the actual weight supported by the first and second drag spring centralizers exceeds approximately four to one.

In yet another aspect of the free point tool of the present disclosure, the low mass sensor assembly comprises a magnetic amplifier sensor enclosed in a sealed, atmospheric pressure capsule and a sensor plate embedded in a sensor sleeve surrounding the pressure capsule and in juxtaposition to the magnetic amplifier sensor, wherein the sensor plate is exposed to pressure within the well casing and is configured to move with zero force, rotationally and longitudinally relative to the sensor within the pressure capsule, during a free point measurement.

In another aspect of the free point tool of the present disclosure, the sensor enclosed in the sealed, atmospheric pressure capsule is constructed as a solid body having no moving parts to provide substantial resistance to shock caused by firing of string shot attached to the lower end of the free point tool.

In another aspect of the free point tool of the present disclosure, the longitudinal and rotational displacement of the movable sensor sleeve relative to the sensor body is limited by a limit screw extending from an outer surface of the sensor body and into a limit opening through an adjacent wall of the sensor sleeve.

In another aspect of the free point tool of the present disclosure, a slack joint is integrated into the structure of the free point tool and a coiled, flexible conduit is provided in the slack range for protecting sensor wiring from pressures and corrosive fluids within the well casing.

In yet another aspect, the free point tool of the present disclosure includes a casing collar locator (CCL), a detonating cap and means for attaching string shot, wherein the CCL provides a triggering circuit for firing the detonating cap at temperatures up to 550 degrees Fahrenheit without requiring the use of semiconductor diodes.

In yet another aspect of the free point tool of the present disclosure, the operation of the CCL is interlocked with the sensor assembly to prevent loading of a collar locating signal, without the use of semiconductor diodes.

In yet another aspect, in a single operation the free point tool of the present disclosure is lifted approximately two feet to reset the free point tool in preparation for both tension and torque measurements, and then lowered approximately one foot to position the free point tool in a mid-point of a slack range.

In yet another aspect, the free point tool of the present disclosure further comprises a sensor processor that automatically compensates for wire line variations such as length, temperature in the well casing at the depth of measurement, and electrical characteristics of the wire line such as resistance, inductance and capacitance.

In yet another aspect, the free point tool of the present disclosure the sensor processor energizes the inductance in the low mass sensor assembly and measures the displacement of the well casing using a single square wave signal applied to the inductance via the wire line.

In yet another aspect of the present disclosure, the displacement of the well casing is converted to a percentage free indication of the well casing at the point of measurement, wherein the percentage free indication is displayed on a meter scale indicating minus 100 percent to zero to plus 100 percent, and calibrated over the full scale after reset of the free point tool using a single operator adjustment.

In yet another aspect, the free point tool of the present disclosure the low mass sensor assembly is configured for high resistance to mechanical shock, elevated temperatures and pressures, and exposure to corrosive materials within the well casing without requiring the use of oil-filled, high pressure enclosures.

BRIEF DESCRIPTION OF THE DRAWINGS

Understanding of the present invention summarized in the foregoing, and of the features and advantages thereof, may be obtained by reference to the detailed description and the accompanying drawings, briefly described below. However, the scope of the present invention is not limited to only the embodiment illustrated in the accompanying drawings, but includes other possible embodiments as defined in the claims.

DETAILED DESCRIPTION OF THE INVENTION

Figure 1A:
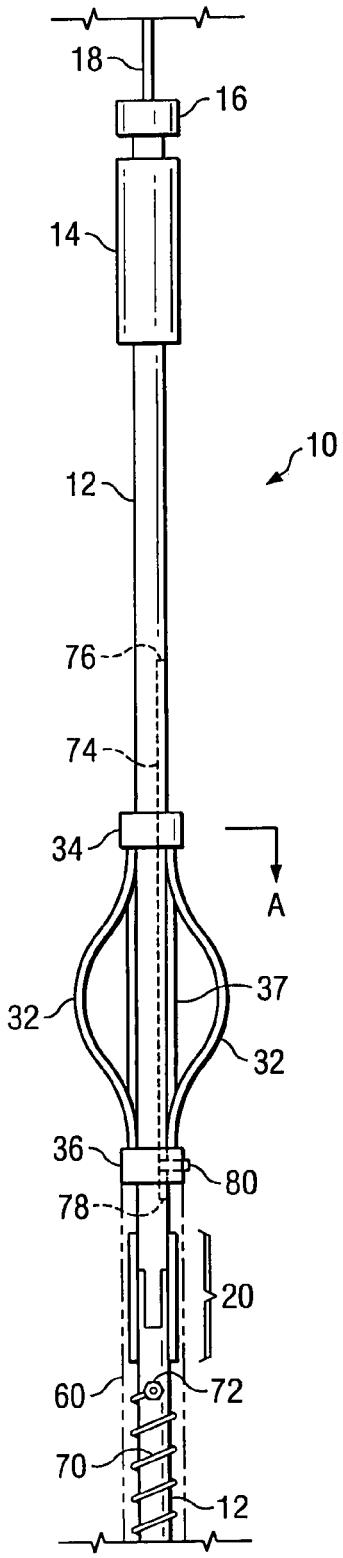
FIG. 1A illustrates a first, upper portion of one embodiment of a free point tool according to the present invention.
Figure 1B:
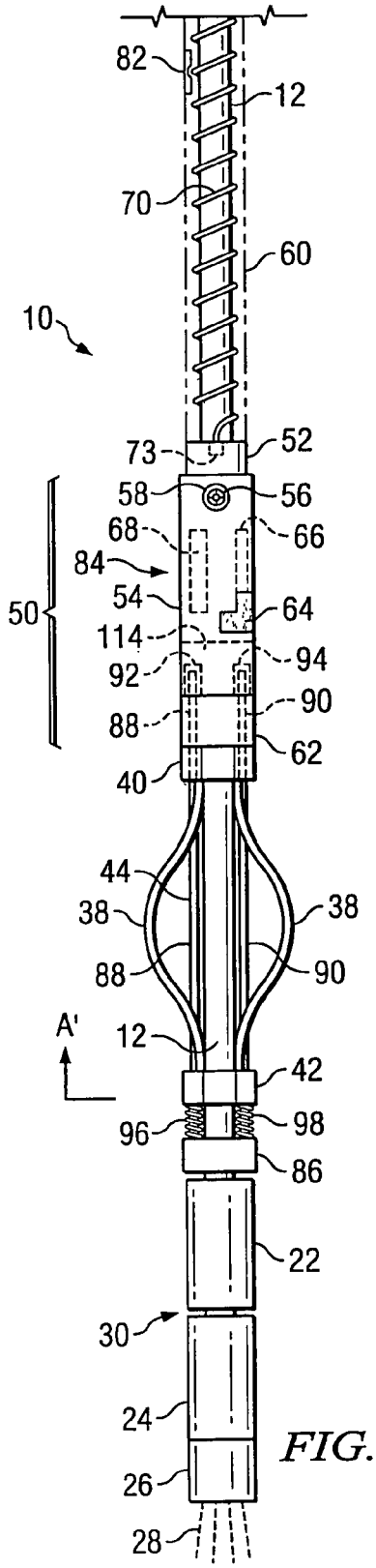
FIG. 1B illustrates a second, lower portion of the embodiment of FIG. 1A.

Referring to FIG. 1A, there is illustrated a first, upper portion of one embodiment of a free point tool according to the present invention. FIG. 1B illustrates a second, lower portion of the embodiment of FIG. 1A. The description of the structures shown in FIGS. 1A and 1B, described together as a single FIGURE, will also serve as an overview of the illustrated embodiment. Further details of both the structure and operation will become clear as the description proceeds to the remaining figures. It will further be appreciated that the orientation of a free point tool, as typical of down hole tools employed in well drilling operations, is to be suspended by a wire line in the well casing, usually below the surface of the earth. In the description which follows, the term "surface" will be taken to mean the surface of the earth and, occasionally, the apparatus and other equipment or personnel associated with the operation of the free point tool.

The free point tool 10 illustrated in FIGS. 1A and 1B includes an elongated main shaft 12 (hereinafter 'main shaft 12') attached using set screws (typically three are used) at an upper end to an upper G. O. connector 14 (hereinafter 'upper GOC 14'). A cable head 16 connects a wireline 18 to the upper GOC 14. The wireline 18 connects the free point tool 10 to service equipment (not shown) on the surface of the earth. The wireline 18 is generally a cable that both supports the free point tool 10 and conducts electrical signals to and from the free point tool 10. The main shaft 12 extends downward through a longitudinal bore in the free point tool 10 to a lower G. O. connector 22 (hereinafter 'lower GOC 22'), also attached with three set screws. The lower GOC 22 connects, in order, the free point tool 10 to a CCL 24, a detonating cap 26 and an assembly of string shot 28, the latter indicated in phantom. Between the lower GOC 22 and the CCL 24 is a space 30 for installing a sinker bar if it is necessary. The CCL 24 contains a triggering circuit for firing the detonating cap 26, which ignites the string shot explosive material, as will be described hereinafter. Further, as is well known in the art, a G. O. connector is a defacto industry standard connecting mechanism used for attaching down hole tools to wirelines and other apparatus connected to the down hole tool.

A sinker bar is a bar of metal that is required with prior art spring tools to provide enough mass to ensure that the tool travels readily down hole within the well casing. As will be described, a sinker bar is not required with the present invention to ensure down hole traverse. Because the free point tool 10 of the present invention has a low mass sensor assembly (to be described), the main shaft 12, though not particularly heavy itself, has sufficient mass to urge the entire free point tool 10 down the well casing to a measurement location. There are some applications, however, when a sinker bar may be used with the free point tool 10 in the space 30, such as to provide a barrier mass to the shock of exploding string shot while loosening a casing collar joint.

The main shaft 12, formed of stainless steel, generally has a round cross section and a gun-drilled bore along the longitudinal axis of the main shaft 12 in the illustrated embodiment. The gun-drilled bore (see, e.g., FIGS. 2 and 3), typically 0.125 inch inside diameter (I.D.), provides a passage for the electrical wire (not shown in FIG. 1A or 1B) to the sensor and CCL components to be described. In the illustrative embodiment, for an overall diameter (O.D.) of the free point tool 10 of 1.375 inches (including a sensor sleeve to be described and the drag springs, when compressed), the main shaft 12 diameter is nominally 0.620 inch. The overall length of the main shaft 12 in the illustrative embodiment is approximately 102 inches. This length allows sufficient length for the freely sliding portion of the free point tool 10, indicated by the letters A-A' in FIGS. 1A and 1B, to move or slide readily along the main shaft 12 during reset and centering steps of its operation, as will be explained. The bore in the components of the free point tool 10, which freely slide along the main shaft 12 is approximately 0.010 inch larger than the diameter of the main shaft 12. The free sliding feature also functions as a built-in slack section, as will be described. For ease of manufacturing, assembly, and maintenance, the main shaft 12 may be fabricated as two pieces, to be connected together by a suitable splice coupling assembly 20, to be described.

Other tool diameters besides the 1.375 inch diameter are feasible with this design, within a range of sizes for use in various sizes and applications of oil and gas well drilling, from approximately the 1.375 inches O.D. of the illustrated embodiment to 3.50 inches O.D. For example, common free point tool sizes in inches are 1.625, 1.688, 1.875, 2.00, 2.125 and 3.50 O.D. The main shaft diameter for larger sizes may the same 0.625 inch or may be proportionally larger to suit the particular application. However, it will be appreciated that the diameter of 1.375 inches is at the smaller end of the range. The initial design and construction, to prove the concept, began with the smaller size because it is the most difficult to manufacture and such smaller tools tend to be more fragile. However, because of the robustness of the design, the 1.375 inch size has demonstrated good manufacturability and exceptional performance and durability.

Referring further to FIGS. 1A and 1B, other features of the main shaft 12 and the free sliding portion A-A' will now be described. The free point tool 10 includes an upper drag spring 32, attached to a first collar 34 and a second collar 36, and a lower drag spring 38, likewise attached to a first collar 40 and a second collar 42. The first and second collars 34, 36 of the upper drag springs 32 are connected to corresponding ends of a drag spring tube 37, which surrounds the main shaft 12. Similarly, the first and second collars 40, 42 of the lower drag springs 38 are connected to corresponding ends of a drag spring tube 44, which surrounds the main shaft 12. The term drag springs in the foregoing sentence appears in the plural sense because in practice typically three such springs are used in each "set" of drag springs, being disposed at 120 degree intervals around the longitudinal axis of the main shaft 12. The sets of drag springs 32, 38, provided to center the free point tool 10 within the well casing and are typically called centralizer springs. However, in this description, the centralizing function of the drag springs 32, 38 will be understood.

The drag springs 32, 38 of the illustrative embodiment may be fabricated of stainless steel or other materials having similar properties to provide adequate resistance to corrosion and other effects of caustic materials that may be present in the wheel fluids surrounding the tool within the well casing. The drag springs 32, 38 are generally adjusted at the surface before the free point tool is lowered into the well. In the illustrated embodiment, although the drag springs 32, 38 may be compressed to the same 1.375 inch diameter as the sensor assembly of the free point tool 10, the tension is typically set to support approximately ten pounds for each set of drag springs (one set being the upper drag springs 32, the other set being the lower drag springs 38). Thus the combined support provided by the drag springs 32, 38 is approximately twenty pounds. As will be described hereinafter, this is approximately four times the weight of the structures that must be supported by the drag springs 32, 38 when the free point tool 10 is in position for making a measurement of the displacement of the well casing during a free point test. This ratio between the total drag spring weight-supporting capacity ("spring capacity") and the weight supported, which is four-to-one or more in the free point tool 10 of the present invention, is one of the key features of the present invention and one of the reasons for its substantial advantages during use as compared with the prior art spring-type free point tools.

Continuing with FIGS. 1A and 1B, other portions of a low mass sensor assembly are illustrated. A subassembly 50 includes a sensor body 52 and a sensor sleeve 54 surrounding the sensor body 52. The sensor body 52, essentially a solid cylindrical structure having a longitudinal bore therethrough, and the sensor sleeve 54 are machined of a non-magnetic material such as stainless steel because of its dimensional stability and resistance to corrosion. The sensor sleeve 54 is configured as a relatively thin-walled tubular form to slide freely along or around the sensor body 52, even though the clearance between them is held closely to 0.005 inch. This clearance is held to this value because the sensor mechanism employs a magnetic amplifier that is sensitive to the gap between portions of the magnetic amplifier constructed of magnetic materials, as will be explained hereinafter. This magnetic gap is configured to vary with the displacement of the well casing being measured in a predictable way, when a tension or torque is applied to the well casing. Thus, the dimensional stability of the sensor body 52 and the sensor sleeve 54 is an important factor in the accuracy, sensitivity and linearity of the sensor mechanism.

The movement of the sensor sleeve 54 relative to the sensor body 52 is limited or restricted to 0.050 inch of longitudinal (parallel to the longitudinal axis of the main shaft 12) or rotational (radially about the longitudinal axis of the main shaft 12) displacement from a central or reset position. This restriction is provided by a limit pin 56 extending radially from the outer surface of the sensor body 52 into a limit opening 58 in the sensor sleeve 54. In the illustrated embodiment, the limit pin 56 may be a round machine screw or dowel, for example, and the limit opening 58 may be a round hole machined through the wall of the sensor sleeve 54. The limit opening 58 has an inside diameter 0.100 inch larger than the outside diameter of the limit pin 56 in the illustrated embodiment. Further, the extension or height of the limit pin 56 above the surface of the sensor body 52 may not exceed the thickness of the wall of the sensor sleeve 54.

This restriction in the movement of the sensor sleeve 54 relative to the sensor body 52, which represents the maximum range of measurement provided in the sensor mechanism, encompasses, with substantial margin, the range of well casing displacements that may be experienced and measured by the free point tool 10 when a tension or torque is applied to the well casing at the surface. As will be described hereinafter, the free point tool includes a reset mechanism that positions the limit pin 56 in the center of the limit opening 58 in preparation for measuring the stretching (tension) or twisting (torque) displacement in the well casing. The limit opening 58 and the limit pin 56 also provides for keeping the sensor sleeve 58 and the sensor body 56, and other structures attached respectively thereto collectively called the low mass sensor assembly, in a defined juxtaposition during the use of the free point tool 10. The use of the free point tool 10 includes lowering the tool down the well casing, resetting the tool to make a measurement, making a measurement, loosening a casing collar, and the like. The low mass sensor assembly includes the structures shown in FIGS. 1A and 1B between the letters A-A'. As will be appreciated from this description, the low mass sensor assembly A-A' is configured to slide as a unit, freely along the main shaft 12, while the free point tool 10 is being reset for a measurement or while making a measurement.

The low mass sensor assembly A-A' further includes a sensor extension 60 connecting the sensor body 52 to the collar 36 of the upper drag springs 32 and a sleeve extension 62 connecting the sensor sleeve 54 to the collar 40 of the drag springs 38. Both the sensor extension 60 and the sleeve extension 62, which function as connecting tubes, are fabricated of thin walled tubing. The sensor extension 60, shown in a broken line outline in FIGS. 1A and 1B, connects the sensor body 52 to the upper drag springs 32, may have the same outside diameter as the sensor body 52 and a length of approximately 36 inches in the illustrated embodiment. The sleeve extension 62, shown in FIG. 1B, is only approximately 1.50 inches long, may have the same outside diameter as the sensor sleeve 54 and couples the sensor sleeve to the first collar 40 of the lower drag springs 38. The sensor extension 60 fixes the relationship of the sensor body 52 to the upper drag springs 32 when the low mass sensor assembly A-A' moves as a unit along the main shaft 12. The sleeve extension 62 fixes the relationship of the sensor sleeve 54 to the lower drag springs 38 when the low mass sensor assembly A-A' moves as a unit along the main shaft 12.

The sensor extension 60 is also long enough to accommodate a length of a coiled conduit 70 therewithin and surrounding the main shaft 12. The coiled conduit 70, which may be fabricated of 0.063 inch diameter O. D. metal tubing, is configured to withstand many cycles of extension and contraction of its coiled length. The coiled conduit 70, which is wound on a 0.800 inch diameter mandrel that is 12.0 inches long, contains and protects a 30 gauge, Teflon-insulated sensor wire (see FIG. 2A, reference number 71) while enabling longitudinal displacement of the conduit 70 as the low mass sensor assembly A-A' moves along the main shaft 12 during a reset operation. During this motion, the overall length of the coiled conduit 70 varies between approximately 12 inches and 36 inches as it is thus respectively extended or contracted within the sensor extension 60. The coiled conduit 70 includes a first connector 72, known in the art as a "swagelock connector." The swagelock connector is a high pressure tubing connector. The 30 gauge wire 71, which may be a continuous length from the upper end of the main shaft 12 to a sensor coil within the sensor body 52, is passed through the conduit 70, the first connector 72, and into the tool or sensor. The first connector 72 is used to connect the sensor wire 174 to the wireline conductor (not shown) within the main shaft 12 and a second connector 73, also a swagelock connector," is used to connect the sensor wire 174 to a part of the sensor mechanism (to be described—see FIG. 3 infra) within the sensor body 52. The coiled conduit 70 and the first and second connectors 72, 73 may be standard hydraulic components adapted to the uses provided in the illustrative embodiment. Also shown within the sensor extension 60 is a splice coupling assembly 20 for coupling first and second halves of a two piece main shaft 12. Providing the main shaft 12 in two halves considerably facilitates the manufacture and assembly of the free point tool 10.

The sub-assembly 50 shown in FIG. 1B includes several additional features. A sensor plate 64 fabricated from a magnetic material forms an integral portion of the sensor sleeve 54, conforming to the same wall thickness and radius of curvature as the rest of the non-magnetic portion of the sensor sleeve 54. The sensor plate 64 is shaped generally like a curved rectangle having a rectangular notch in one corner, which will be described further in conjunction with FIGS. 5, 8 and 9 infra. Shown in phantom lines in FIG. 1B are a sensor inductor 66 and a CCL reed switch 68, which are embedded within the sensor body 52. Both the sensor inductor 66 and the CCL reed switch 68 are cylindrical structures situated parallel to the longitudinal axis of the main shaft 12 and generally on opposite sides of the main shaft 12. They are disposed between the longitudinal bore through the sensor body 52 that receives the main shaft 12 and the outer surface of the sensor body. The sensor plate 64 interacts with the sensor inductor as the sensor sleeve 54 moves relative to the sensor body 52 corresponding to the stretching or twisting imparted to the well casing during a measurement being made by the free point tool 10.

Continuing with FIG. 1A, there is shown a key way 74 machined into a side of the main shaft 12 and having an upper end 76 and a lower end 78. The key way 74 in this illustrative embodiment is a rectangular groove approximately 30 inches long, 0.250 inch wide and 0.125 inch deep. A guide pin 80 having a diameter of approximately 0.230 inch, which functions as a key, is disposed within the second collar 36 of the upper drag springs 32 and extending into the key way 74. The guide pin 80 acting in cooperation with the key way 74 restricts the movement of the low mass sensor assembly A-A' along the main shaft 12. Because of the dimensions noted above, the total relative rotational movement of the low mass sensor assembly A-A' with respect to the main shaft 12 is limited to approximately 0.020 inch. Similarly, the total relative longitudinal movement of the low mass sensor assembly A-A' with respect to the main shaft 12 is limited to approximately 24 inches, which is adequate to permit resetting the free point tool 10. The guide pin 80 and key way 74 also permit the combination of the low mass sensor assembly A-A' and the main shaft 12 to cooperate as a slack joint built in to the free point tool 10. The advantage of such a structure should be readily apparent to those skilled in the art because no other slack joint need be provided with the free point tool 10 of the present invention, thus realizing a significant length and weight savings.

In describing the structure and operation of the reset mechanism provided in the free point tool 10, reference will be made to pulling up on the wire line 18 a distance of two feet and then lowering the free point tool 10 by one foot to reset the tool. At either end of the two foot excursion a control mechanism is provided to enable the operation of the CCL locator or the firing of the string shot 28 attached to the lower end of the free point tool 10. This control mechanism opens the low resistance sensor coil circuit during a CCL measurement or reset operation when the tool is pulled up or down to its maximum excursion. The control mechanism is operated by two small bar magnets 82, 84 embedded in the surface of the main shaft 12 at the points indicated in FIG. 1B. The first magnet 82, shown within the broken line outline of the sensor extension 60 and proximate a portion of the conduit 70, is located toward an upper end of the excursion of the low mass sensor assembly A-A'. The second magnet 84 is not shown in FIG. 1B but is located just behind the phantom outline of the CCL reed switch 68 as indicated by the arrow from reference number 84. The first and second magnets 82, 84 cooperate with the CCL reed switch 68 by breaking a connection in the sensor circuit within the sensor body 52 which disables the sensor when the low mass sensor assembly A-A' is at either end of its allowable excursion. The connection referred to is provided by normally closed (N.C.) contacts of the CCL reed switch 68. When one of the small magnets 82, 84 becomes in proximity of the CCL reed switch 68, the N.C. contacts open to disable the sensor. It will be appreciated that the low mass sensor assembly A-A' is shown in its lowest position in FIG. 1B; therefore in the position shown, the CCL reed switch N.C. contacts would be open and the sensor inoperative, to permit energizing the detonating cap 26 if a suitable signal is applied to the wire line 18.

Continuing with FIG. 1B, a portion of the aforementioned reset mechanism is shown. A reset ring 86 is shown surrounding the main shaft 12. The reset ring 86 is configured to slide freely along the main shaft 12 whenever the wire line 18 is pulled upward or lowered downward. The reset ring 86 rests against the upper end of the GOC 22 when the low mass sensor assembly A-A' is in its lowest position as shown in FIG. 1B. Extending upward a distance of approximately 18.75 inches (in the illustrative example) from the reset ring, through the drag spring tube 44, on opposite sides and closely adjacent to the main shaft 12, are first and second reset rods 88, 90. The first and second reset rods 88, 90 continue upward through the first collar 40, the sleeve extension 62 and into first and second recesses 92, 94 formed into a reset cap 114. The reset cap 114 is configured as an extension to the sensor body 52, having the same diameter, being disposed within the sensor sleeve 54 and connected to the lower end of the sensor body 52. The connection of the reset cap 114 to the sensor body 52 is such that the sensor body 52 rotates within the sensor sleeve 54 whenever the reset cap is rotated. Disposed respectively around each first and second reset rod 88, 90 and just above the reset ring 86 are first 96 and second 98 coil springs for maintaining the spacing between the low mass sensor assembly A-A' and the CCL 22.

Figure 1C:
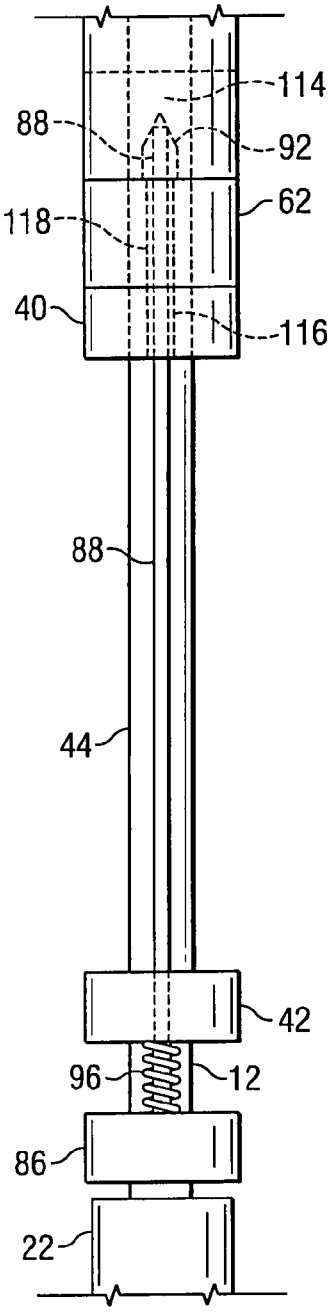
FIG. 1C illustrates an enlarged view of one side of a portion of the embodiment of FIG. 1B.

Referring to FIG. 1C, there is illustrated an enlarged view of one side of a portion of the embodiment of FIG. 1B, provided to illustrate the operation of the reset mechanism. The perspective is from a point 90 degrees to the left of the perspective of FIG. 1B. All of the structures shown in FIG. 1C bear the same reference numbers as in FIG. 1B. However, the lower drag springs 38 and the drag spring tube 44 are removed for clarity. The first reset rod 88 is shown with its respective first coil spring 96 and extending upward through the second collar 42, the first collar 40, the sleeve extension 62 and into the first recess 92 in the reset cap 114. It will be observed that the shape of the first recess 92 is as an inverted V shape. Thus, when the first reset rod 88 extends upward into the first recess 92, against the opposing force of the first spring 96, the first reset rod 88 bears against the ramp surface of the inverted V shape of the first recess 92, causing the reset cap 114 and the sensor body 52 to rotate within the sensor sleeve 54. The action is the same for the second reset rod 90, acting in its respective second recess 94. The combined action exerts a uniform torque upon the sensor body to center it rotationally with respect to the sensor sleeve 54. The dimensions and travel of the reset structure components are provided to center the sensor body 52 longitudinally within the sensor sleeve 54 when the reset rods extend fully into the respective first and second recesses 92, 94. The upward travel of the reset rods 88, 90 to cause the longitudinal centering to occur is set in the illustrated embodiment at 0.500 inch. The motion of the first and second reset rods 88, 90 is limited to movement parallel to the main shaft 12 by the dimension of the holes 116 and 118 respectively through the first collar 40 and the sleeve extension 62

Figure 2A:
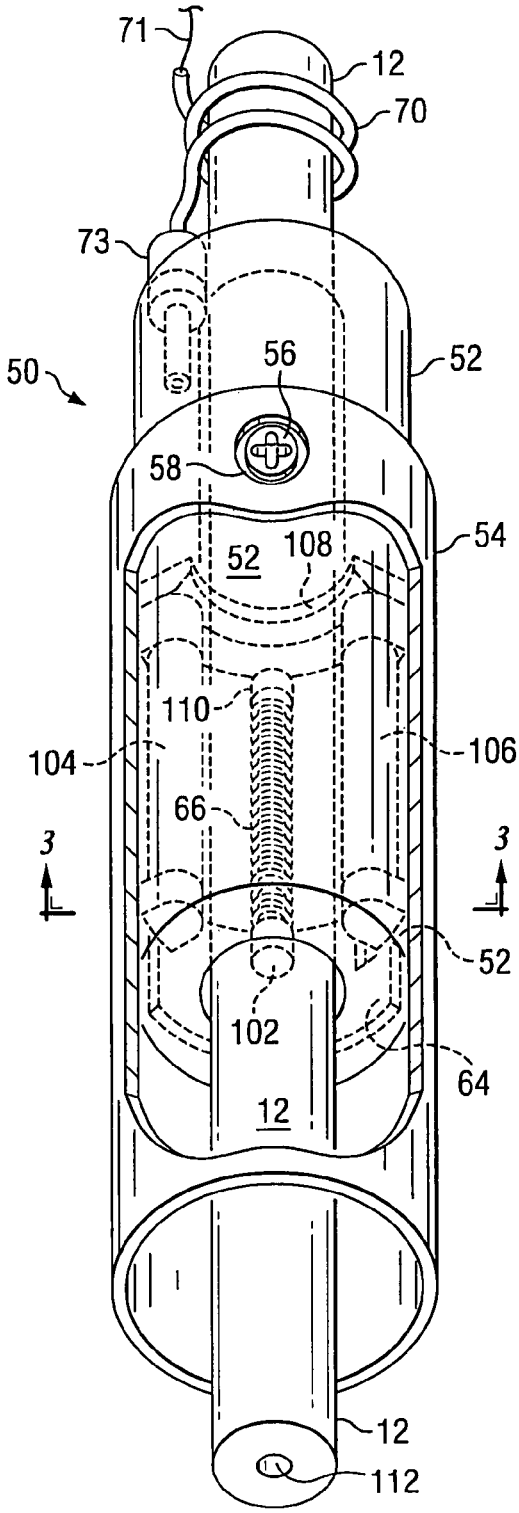
FIG. 2A illustrates a cutaway view of one embodiment of a sensor sub-assembly used in the low mass sensor assembly illustrated in FIG. 1A.

Referring to FIG. 2A, there is illustrated a cutaway view of one embodiment of a sensor sub-assembly used in the low mass sensor assembly A-A' illustrated in FIG. 1A. The main shaft 12, gun-drilled to provide a passage for the electrical wire from the wireline cable 18 to the low mass sensor assembly A-A' and the CCL 22, is shown passing through the longitudinal bore of the sensor body 52. Slidingly disposed over the sensor body 52 is the sensor sleeve 54, shown cut away to reveal portions of the internal structure of the sensor body 52 shown in phantom outline. As previously described, the movement of the sensor sleeve 54 relative to the sensor body 52 is limited or restricted to 0.050 inch of longitudinal or rotational displacement from a central or reset position. This restriction is provided by the limit pin 56 extending radially from the outer surface of the sensor body 52 into the limit opening 58 in the sensor sleeve 54. In the illustrated embodiment, the limit pin 56 may be a round machine screw or dowel, for example, and the limit opening 58 may be a round hole machined through the wall of the sensor sleeve 54. The limit opening 58 has an inside diameter 0.100 inch larger than the outside diameter of the limit pin 56 in the illustrated embodiment. Further, the extension or height of the limit pin 56 above the surface of the sensor body 52 may not exceed the thickness of the wall of the sensor sleeve 54.

The coiled conduit 70 is shown in FIG. 2A, as is a second insulated swagelock connector 73 that connects the 30 gauge, Teflon insulated sensor wire 71 to a part of the sensor mechanism (to be described—see FIG. 3 infra) within the sensor body 52. The coiled conduit 70 and the swagelock connector 73, which may be screwed into a tapped hole (not shown) in the end of the sensor body 52 may be standard hydraulic components adapted to the uses provided in the illustrative embodiment.

Shown in phantom outlines are sensor structures internal to the sensor body 52, all of which are arranged within one side of the sensor body 52 in the region between the central main shaft bore and the outer surface of the sensor body 52. These include a cylindrical sensor coil 66 of approximately 1000 turns of No. 44 HML insulated copper wire wound on a PEEK coil form and having a Mu-metal inductor core having a Mu of approximately 35,000 in the illustrated embodiment. The inductor core of the sensor coil 66 is shown having a first (lower) end 102 and a second (upper) end 110. The sensor coil 66 is situated parallel to the longitudinal axis of the main shaft 12. Disposed parallel to the sensor coil 66 are first 104 and second 106 rare earth bar magnets. Each bar magnet 104, 106 is approximately 0.25 inch in diameter and approximately 1.5 inches long. A pole piece is attached to the upper end of each of the bar magnets 104, 106. Within an upper end of the sensor body 52 is disposed a soft iron pole piece 108, which is in contact with the upper ends of the pole pieces of the first and second bar magnets 104, 106. It should be noted that the pole piece 108 is not in contact with the adjacent upper end 110 of the sensor coil 66, there being a predetermined gap provided therebetween to provide a known amount of reluctance in the magnetic circuit of the magnetic amplifier. The sensor coil 66, the first and second bar magnets 104, 106, and the pole piece 108 form the stationary part of the magnetic amplifier circuit in the sensor sub-assembly. Further, the lower ends of the first and second bar magnets 104, 106 and the sensor coil 66 (the lower end being 102) are disposed in approximately the same plane at a cross section of the sensor body 52.

A moving part of the magnetic amplifier, integrally embedded in the wall of the sensor sleeve 54, is a sensor plate 64, shown in phantom outline in FIG. 2A. It is apparent in FIG. 2A that the sensor plate 64 includes a rectangular notch in the corner thereof nearest the adjacent end of the second bar magnet 106. The notch in the sensor plate 64 plays a key role in the function of the magnetic amplifier circuit, to be described in conjunction with FIGS. 5, 8 and 9. As will be described hereinafter, as the sensor sleeve 54 moves relative to the sensor body 52, within the constraints provided by the limit pin 56 and the limit opening 58, the sensor plate 64 moves relative to the adjacent ends of the sensor coil 66 and the first and second bar magnets 104, 106. This relative movement, which is proportional to the displacement of the well casing when placed under a tension or torque applied at the surface, is sensed as a change in the inductance of the sensor coil 66. The change in the inductance of the sensor coil 66 is measured and converted to a meter reading on the panel of a surface instrument to be described.

Figure 2B:
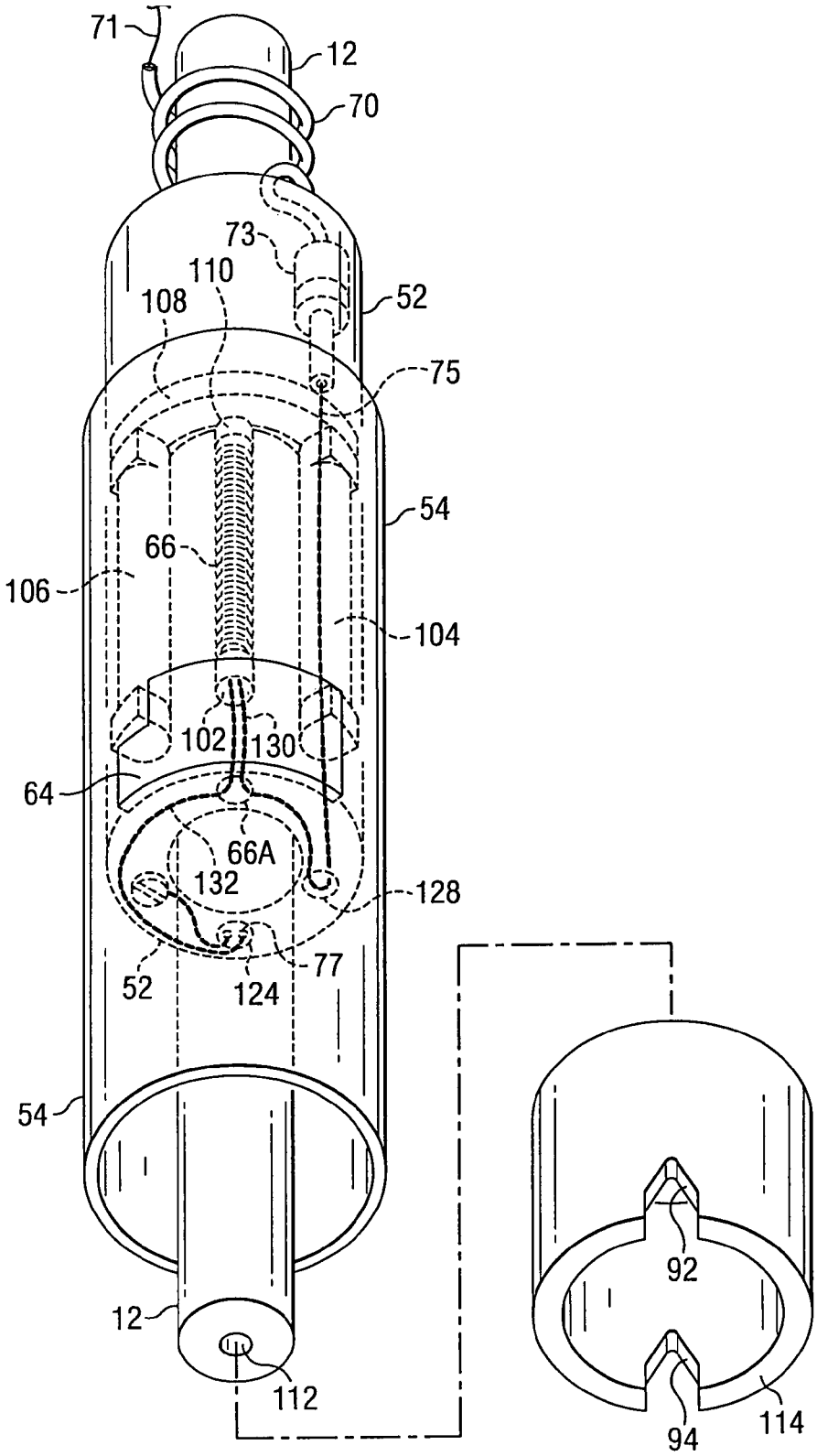
FIG. 2B illustrates the embodiment of FIG. 2A as viewed from its opposite side.

FIG. 2B illustrates the embodiment of FIG. 2A as viewed from its opposite side wherein the same structures are shown and bear the same reference numbers. FIG. 2B should be understood in conjunction with FIG. 3, which illustrates a cross section of the sensor for describing internal wiring of the sensor body 52. Several additional features are illustrated, including the sensor wire 75, shown as a dashed line extension of the conductor 71, from the conduit 70, through a passage 128 (See FIG. 3) in the sensor body 52 to the lower end 102 of the sensor coil 66. In the illustrated embodiment, the leads of the sensor coil 66 are disposed at the same end, lower end 102. One lead 130 connects to the sensor wire 75 and the other, return lead 132 connects to a return terminal 77 of a reed switch 124 disposed in a hole 126 (See FIG. 3). The sensor lead 75 emerges from the passage 128 in the sensor body 52 and is dressed in a groove 120 (See FIG. 3) machined in the end of the sensor body 52 to connect to the sensor coil 66.

Also shown in FIG. 2B is a reset cap 114 having the first and second recesses 92, 94 formed in the lower end thereof. The recesses 92, 94 in the reset cap 114, shaped at the upper end like an inverted letter V, provide angled ramp surfaces for the reset rods 88, 90 to bear against, applying a torque to the reset cap 114 and the attached sensor body 52. It will be appreciated that the reset cap 114 and sensor body 52 combination rotates around the main shaft 12 as a unit as the reset rods 88, 90 enter the recesses 92, 94, applying a torque to the reset cap 114. The reset cap 114 may be fabricated of the same stainless steel material as the sensor body 52, is attached to the adjacent end of the sensor body 52, and fits within the sensor sleeve 54 and around the main shaft 12. The method for attaching the reset cap 114 to the sensor body 52 is not shown for reasons of clarity in the drawing. Preferably, the illustrated embodiment may utilize three small screws disposed at 120 degree intervals around the circumference of the reset cap. It will be appreciated that such mechanical attachments are well known to persons skilled in the machine arts.

Figure 3:
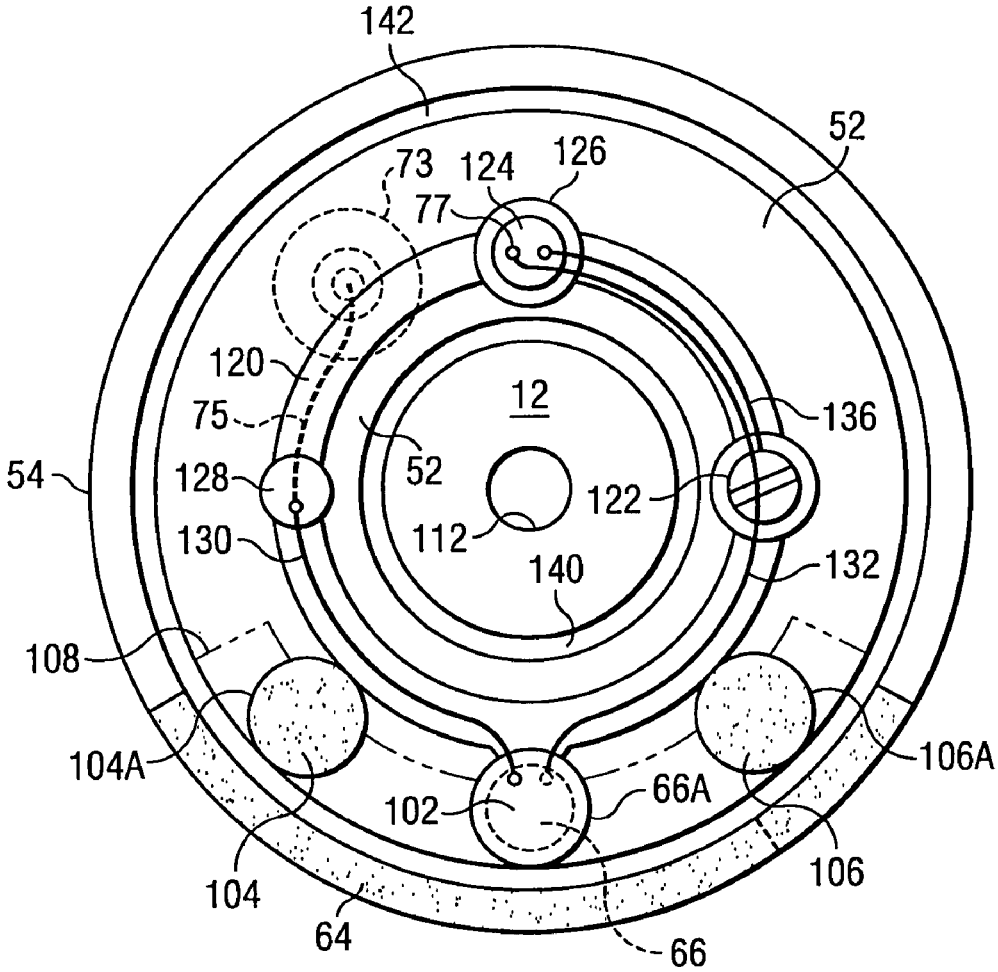
FIG. 3 illustrates a cross section view of the embodiment of FIG. 2A.

Referring to FIG. 3, there is illustrated a cross section view of the embodiment of FIG. 2A, showing the lower end of the sensor body 52 as it would appear with the reset cap 114 removed. It will be noted that the solid lines indicate structures in the plane of the cross section and dashed lines indicate structures in more distant perspective in a cross section farther from the plane of the page. Further, it will be appreciated that the main shaft 12 (with its gun-drilled hole for the electrical wire through the free point tool 10 from the wire line cable 18 to the CCL 22), the sensor body 52 and the sensor sleeve 54 appear as successively concentric bodies, with clearances between each adjacent member. For example, the clearance between the main shaft 12 and the sensor body 52 is shown as the space 140. This clearance is approximately 0.010 inch in the illustrative embodiment. Similarly, the clearance between the sensor body 52 and the sensor sleeve 54 is shown as the space 142. This clearance is closely held at approximately 0.005 inch as mentioned previously. Thus, the structure of the sensor portion of the free point tool 10 can be described as a body formed of first and second concentric, tubular regions (the sensor body 52 and the sensor sleeve 54) surrounding a central bore along their common axis, the bore configured for freely receiving an elongated main shaft (12) of the free point tool (10). The concentric bodies are configured to move freely relative to one another. The presence of drilling mud used in most well drilling applications provides more than adequate lubricity to the sliding surfaces. As is well known, drilling mud is composed of lubricating liquids and finely ground barite and clays, which resembles a viscous mixture having a high concentration of very small (e.g., 25 microns in diameter, typically) ball bearing-like particles.

Continuing with FIG. 3, the lower ends of the sensor coil 66 (with its lower end 102 visible), and the first and second bar magnets 104, 106 are shown, disposed in respective holes 66A, 104A, and 106A in the sensor body 52. An edge-wise section of the sensor plate 64 is also shown in FIG. 3, in the shaded (i.e., magnetic structure) portion of the wall of the sensor sleeve 54. The bar magnets 104 and 106 are also shaded to indicate their magnetic properties. Further, in the plane of the cross section of FIG. 3, is shown a circular groove 120 machined into the end of the sensor body 52, which provides a wiring trough for connecting several of the components of the magnetic amplifier assembly to each other. Arranged in the path of the groove 120 are a grounding screw 122, a first hole 126 (perpendicular to the plane of the figure) that contains a sensor reed switch 124 to be connected between the ground screw 122 and the lower end 102 of the sensor coil 66, and a second hole 128 (also perpendicular to the plane of the figure) to provide for passage of the sensor wire 75 (see FIG. 2B), shown as sensor wire 130 in FIG. 3, from the distal end of the sensor body 52. In FIG. 3, the return wire 132 connecting the sensor reed switch 124 to the sensor coil 66 is shown in the groove 120 on the near (lower) end of the sensor body 52. The second swagelock conduit connector 73, disposed on the distal end of the sensor body 52, is shown in phantom. It will be appreciated that wires positioned on the distal (upper) end of the sensor body 52 may be routed in grooves similar to the groove 120.

Figure 4A:
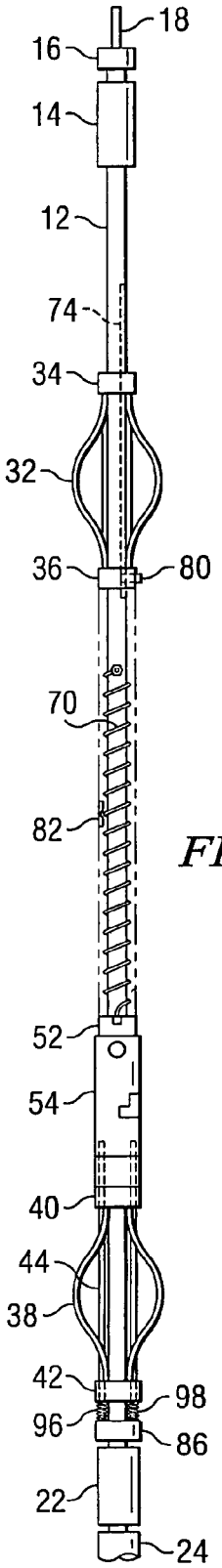
FIG. 4A illustrates the embodiment of FIGS. 1A and 1B with the sensor-and-drag spring assembly in a lower position along the main shaft.

Referring to FIG. 4A, there is illustrated the embodiment of FIGS. 1A and 1B with the low mass sensor assembly A-A' (i.e., the sensor-and-drag spring assembly) in a lower position along the main shaft 12. This lower position corresponds to the position of the sensor-and-drag spring assembly when the conduit is extended and before the reset operation is performed. FIG. 4A is very similar to FIGS. 1A and 1B combined and the numbered structures shown in FIG. 4A bear the same reference numbers as in FIGS. 1A and 1B.

Figure 4B:
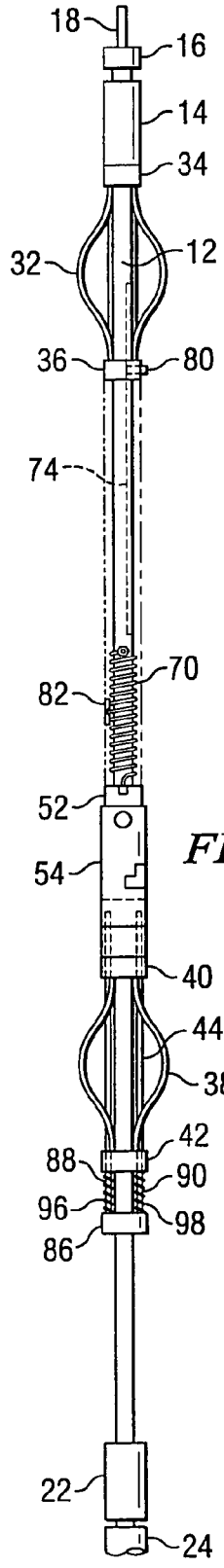
FIG. 4B illustrates the embodiment of FIGS. 1A and 1B with the sensor-and-drag spring assembly in an upper position along the main shaft.

In FIG. 4B, the sensor-and-drag spring assembly is shown in an upper position along the main shaft 12, approximately two feet above the lower position, after pulling upward on the main shaft 12 to perform the operation to reset the low mass sensor assembly A-A'. This operation centers the limit pin 56 extending from the sensor body 52 within the limit opening 58 through the sensor sleeve 54). It should be noted that the first and second coil springs 96 and 98 are shown extended to a length of approximately one inch after the reset operation is performed and the upward tension on the main shaft relaxed. This contrasts with the configuration shown in FIG. 4A, in which the first and second coil springs 96 and 98 are compressed to a length of approximately one-half inch, which corresponds to the extension of the first and second reset rods 88 and 90 into the inverted V-shaped openings 92, 94 in the reset collar 114 by approximately the same one-half inch distance (See FIG. 2B) during the reset operation described hereinabove. Thus, FIG. 4B shows the free point tool 10 just before the operation to center the free point tool 10 in the center of the slack range built into the free point tool 10. To center the free point tool 10 in the center of the slack range, the main shaft of the tool is lowered approximately one foot from the upper position shown in FIG. 4B. The configuration of the free point tool 10 after centering it in the center of the slack range is not separately shown in the drawings but would appear approximately intermediate the positions shown in FIGS. 4A and 4B. The two foot upward excursion the low mass sensor assembly A-A' makes with respect to the main shaft 12 during reset, and the one foot downward excursion during centering, are empirically determined to allow for several factors. These factors include movement of the drill pipe and the wire line that supports the free point tool 10 during a measurement, the tolerances of manufacturing, and the tolerances of operator expectation and performance. The numbered structures of FIG. 4B bear the same reference numbers as in FIG. 4A, and will not be further identified.

Figure 5:
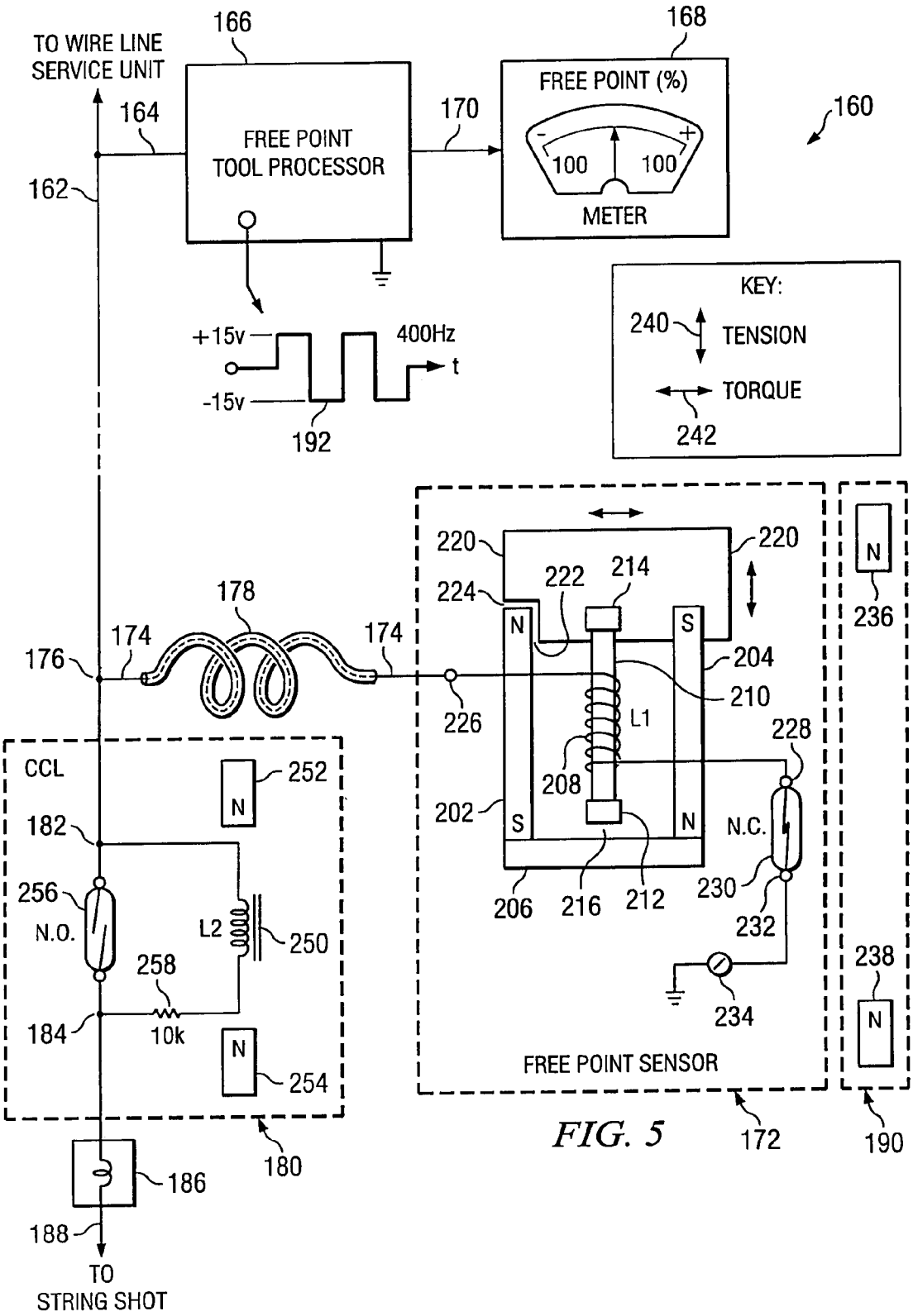
FIG. 5 illustrates a pictorial block diagram of the electrical circuit portion of the free point tool of the present invention.

Referring to FIG. 5, there is illustrated a pictorial block diagram of the electrical circuit portion 160 of the free point tool 10 of the present invention. An electrical wire 162, which is a part of the wire line 18 shown in FIG. 1A, provides a conduction path for electrical signals between the free point tool processor 166 (via lead 164) and the free point sensor 172 (via sensor wire 174 at node 176, the sensor wire 174 shown within the conduit 178), and also the CCL 180 (at node 182). The CCL 180, which is also called the CCL detection circuit 180 in the description hereinbelow, is further connected to the detonating cap 186 for the string shot (via node 184 and wire 188). The free point sensor 172 represents the combination of the sensor body 52 and the sensor sleeve 54 and the internal components thereof to be described. It should be appreciated that the free point sensor 172 illustrates the operative components of the magnetic amplifier embodied in the low mass sensor assembly A-A' previously described. A free point meter 168, for indicating the freeness of the well casing being measured, is connected to an output line 170 from the free point tool processor 166. One of the principal functions of the free point tool processor 166 is to generate a 400 Hz square wave 192 to be coupled to the free point sensor 172 via the lead 164, electrical wire 162, and sensor wire 174. As will be described in conjunction with FIGS. 7A and 7B, a change in the inductance of the sensor coil 208 (shown as L1 in FIG. 5 and by reference number 66 in FIGS. 2A, 2B, and 3) in the free point sensor 172 alters the waveform shape during a measurement of the displacement of the well casing. The free point tool processor 166 measures the alteration in the square wave and converts the measurement to an indication on the free point meter 168.

Continuing with FIG. 5, the CCL 180 includes a CCL inductor 250 (L2) coupled in series with a resistor 258 between the nodes 182 and 184. Nodes 182 and 184 connect to the terminals of a normally open (N.O.) reed switch 256 connected in series with the wire line electrical wire 162 and the detonating cap 186. The reed switch 256 may be functionally identified as a CCL trigger 256. Node 182 is connected to the electrical wire 162 and node 184 is connected to the detonating cap 186, which in turn is connected to the string shot (not shown) via a conductor 188. The L2 inductor 250 is situated between the north poles of first and second CCL magnets 252, 254, which are aligned with the longitudinal axis of the cylindrical core of the L2 inductor 250. The resistance of the L2 inductor, typically approximately 2000 Ohms at room temperature, is approximately 4,000 Ohms at operating temperatures in a well. The first and second CCL magnets 252, 254 may be standard Alnico 5, or Alnico 8, or any of a wide variety of types available for this type of application.

The purpose of the CCL magnets 252, 254 is to ensure that the net magnetic field in the vicinity of the CCL trigger (reed switch) 256 is zero except (a) when it is desired to trigger the detonating cap 186 by causing the N.O. contacts in the CCL trigger 256 to close; and (b), the primary purpose—when the CCL is being used to locate casing collars as the tool is pulled upward or lowered downward in the well casing. In the first case, the "trigger" mode, the CCL trigger 256 is enabled by a signal applied to the wire line at the surface from a "shooting panel" (not shown), after the free point tool processor is disconnected. This signal swamps the effect of the CCL magnets 252, 254. This signal is provided when the sensor reed switch 230 in the free point sensor 172 is activated by raising or lowering the free point tool 10 to a maximum upward or downward position, which opens the sensor reed switch 230. When the CCL trigger 256 is activated, i.e., the N.O. contacts are closed, a firing voltage present on the electrical wire at node 182 is coupled to the detonating cap 186. This firing voltage heats the resistance element in the detonating cap 186, causing ignition of the string shot 188 attached to the detonating cap 186.

In the second case, the "locator" mode, the purpose of the CCL magnets 252, 254 is fulfilled when it is necessary to move the free point tool upward or downward in the well casing. In the locator mode, the free point tool processor is connected and the mode switch 326 set to the CCL position. The magnets 252, 254 act in conjunction with the CCL inductor 250 as a dynamo—a motor generator that generates a small voltage signal across the CCL inductor 250 as a casing collar moves past first one magnet 252 or 254 and then the other 254 or 252. The casing collar, being more dense than the rest of the casing, changes the flux in the magnets, causing a current to flow in the CCL inductor 250 and a voltage drop to be produced across the CCL inductor 250. As the casing collar moves past first one magnet then the other a positive voltage spike appears followed by a negative spike, the entire signal having an amplitude of, perhaps, two Volts peak-to-peak. Thus, the operator on the surface, by observing the meter deflection corresponding to the spike signal can identify the location of the casing collars, estimate distances relative to a particular point in the well casing (because the sections of drill pipe or well casing joined by the casing collars are of a known, uniform length), and the like. The CCL circuit dynamo thus generates a very useful marker signal. This operation of the CCL 180, i.e., the CCL detection circuit 180, is interlocked with the free point sensor 172 as will be described further hereinbelow.

Continuing with FIG. 5, the sensor wire 174, after passing through the conduit 178 is connected to a node 226, which is one terminal of the sensor coil 208 within the free point sensor 172. For reference, the sensor coil 208, also shown as inductance L1, is the sensor coil 66 shown in FIGS. 2A, 2B, and 3; and the node 226 corresponds to the lead 132 in FIG. 3. The lead from the opposite end of the sensor coil 208 is connected to a first terminal 228 of the sensor reed switch 230. Sensor reed switch 230, which is the same as the sensor reed switch 124 in FIG. 3, contains one set of normally closed (N.C.) contacts. The second terminal 232 of the sensor reed switch 230 is connected to the ground screw 234 (the same as the ground screw 122 in FIG. 3) within the sensor body as shown and described hereinabove for FIG. 3.

Associated with the sensor reed switch 230 are small, first 236 and second 238 magnets, which are embedded in the surface of one side of the main shaft 12 shown in FIG. 1B. The first and second magnets 236, 238, which are spaced apart along the main shaft 12 by a distance of approximately two feet, are the same as the first and second magnets 82, 84 shown and described in FIG. 1B. The first and second magnets 236 (82), 238 (84) cooperate with the sensor reed switch 230 by breaking the ground connection of the sensor coil 208, which disables the sensor when the low mass sensor assembly A-A' is at either end of its allowable excursion. This ground connection is broken when one of the first and second magnets 236, 238 becomes in proximity of the sensor reed switch 230, causing the N.C. contacts to open to disable the sensor and enable the CCL 180 in both the trigger mode and the locator mode associated with operation of the CCL 180 described previously. It will be appreciated that this action occurs when the sensor reed switch 230 is positioned exactly proximate either of the first and second magnets 236, 238, corresponding to when the low mass sensor assembly A-A' is in its lower most (as in FIG. 1A-1B) or in its upper most (as in FIG. 4B) position. In these positions, the free point sensor 172 is not required to be operative, it being recalled that the low mass sensor assembly A-A' is reset and centered for a measurement, wherein it is positioned near the center of its operating range, away from the maximum upper and lower excursions, which excursions place the low mass sensor assembly A-A' in proximity to either of the first and second magnets 236, 238. It is only at these maximum excursions that the CCL trigger and locator functions are enabled by causing the N. C. contacts of the sensor reed switch 230 to open and permit energizing the detonating cap 186 if a suitable signal is applied to the wire line 18. It is this function of the sensor reed switch 230 and the associated first and second magnets 236, 238, which provide the aforementioned interlock of the CCL detection circuit 180 with the sensor 172.

The sensor reed switch 230 provides this interlock with the CCL 180 when the free point tool is pulled upward or lowered downward in the well casing so that the CCL 180 may be operated in either the trigger mode or the locator mode. In the trigger mode, a DC trigger voltage is applied to the wire line 162 at the surface from the "shooting panel" (not shown). The resistance of the sensor coil 208 is approximately 62 Ohms in the illustrative embodiment. The resistance of the CCL inductor 250 is approximately 4,000 Ohms. When the N. C. contacts of the sensor reed switch 230 are closed, the sensor coil circuit acts as a voltage divider with the much larger resistance of the electrical wire 162 in the wire line 18 to cause relatively little voltage to appear at node 176. If the sensor reed switch 230 is caused to open, the voltage divider action is no longer effective, and the full voltage present at the node 176 is applied across the CCL inductor 250, which causes the CCL reed switch 256 to close its contacts to allow the detonating cap 186 to be energized. Similarly, in the locator mode, removing the low impedance of the sensor 172 from the node 176 enables the full voltage generated by the CCL detection circuit 180, when it is moved past a casing collar, to be generated and sensed by the free point tool processor 166. In these ways, the CCL is, in effect, interlocked with the low mass sensor assembly 172 (A-A' in FIGS. 1A and 1B) of the free point tool. In other words, the CCL is configured to be inoperative when the free point tool 10 of the present invention is operated to trigger the string shot or when performing free point measurements to locate the stuck point in the well casing.

In the trigger mode, the trigger voltage signal applied to the wire line 162 (reference number 18 in FIG. 1A), to trigger the CCL circuit 180 in the illustrative example, is a DC voltage of at least 50 Volts. The 50 Volts DC, when applied across the CCL inductor 250 sets up a magnetic field in the CCL inductor 250 which opposes one (but not both, because of their opposing polarities) of the CCL magnets 252, 254, allowing the other magnet to affect the CCL reed switch 256 by causing its N. O. contacts to close. Upon closing, the contacts of the CCL reed switch 256 allow the applied DC trigger voltage to heat the heating element in the detonating cap 186 and ignite the string shot connected to the line 188. It will be appreciated that the DC trigger voltage may be either positive or negative. Further, after the stuck point is located, a left-hand torque is applied (one-half turn per thousand feet of free pipe), and the string shot is ignited, the free point may be removed before operations to loosen the stuck pipe are begun. The CCL trigger operation occurs after the stuck point is located and the free point tool pulled up at least two feet. This action positions the low mass sensor assembly A-A' at an upper or lower position along the main shaft 12 to enable the CCL circuit 180. The rating of the sensor reed switch 230 in the illustrative embodiment is 200 Volts with a contact rating of 1 Ampere. The rating of the CCL reed switch 256 in the illustrative embodiment is 400 Volts with a contact rating of 6 Amperes. The small first and second magnets 236, 238 are conventional bar magnets. The first and second CCL magnets 252, 254 are also conventional bar magnets.

Continuing with FIG. 5, the structure of the magnetic amplifier sensor, the "free point sensor 172" will be further described. The pictorial illustration of the free point sensor 172 provides a lateral view of the magnetic amplifier as it would look if its components were arranged in the plane of the drawing. To imagine the physical arrangement of these components in the low mass sensor assembly A-A', one only need to lift the left and right edges of the dashed line outline 172 toward the viewer so as to curve the plane of the drawing as if it were about one third of the circumference of the outer surface of a cylinder, and also to imagine that the various components have their actual three-dimensional structure. This is somewhat like the view presented in FIG. 2A, if it were inverted (i.e., just hold the page with FIG. 2A upside down). The sensor coil 208, a cylindrical inductor wound on a Mu-metal core with a Mu of approximately 350,000, has been described previously. The first 202 and second 204 rare earth bar magnets and the soft iron pole piece 206 have also been previously described. Further, the sensor plate 220, formed of a magnetic material is shaped like a curved rectangle as an integral portion of the wall of the thin-walled sensor sleeve. A rectangular notch formed in the lower (left, in this view) corner has also been described. It will be appreciated that these components form a magnetic circuit, loosely resembling an E-I core, wherein the first and second magnets 202, 204, the sensor inductor 208, and the pole piece 206 form the E core. The sensor plate 220 may be thought of as the I core portion.

There are two kinds of gaps—reluctance elements—in this magnetic circuit. A first gap 216 exists between the lower end 212 (actually a small pole piece) of the sensor coil 208 and the soft iron pole piece 206. This first [kind of] gap 216 is fixed by the dimensions of the sensor body 52 (see FIG. 2A, e.g.) wherein the magnetic circuit components, except for the sensor sleeve 54, are disposed in machined voids in the solid material of the sensor body 52. The second [kind of] gap exists between the sensor plate 220 and the proximate (i.e., uppermost in the figure) ends of the first and second bar magnets 202, 204 and the sensor coil 208. This kind of gap, or set of gaps, occurs because the sensor plate is part of the sensor sleeve 54 (in FIG. 2A), which is separated from the sensor body 52 (that contains the other magnetic circuit components) by the aforementioned clearance of approximately 0.005 inch. This clearance is a fixed value, so the gap provided in this radial dimension (with respect to the longitudinal axis of the main shaft 12) remains constant.

However, as the sensor sleeve 54 moves relative to the sensor body 52, rotationally or longitudinally, another, variable component of the gap between the sensor plate and the other components is provided in the vicinity of the rectangular notch. This gap is indicated in FIG. 5 by the reference number 222 for the case of a gap varied by the rotation of the sensor sleeve about the sensor body, and by the reference number 224 for the case of a gap varied by the longitudinal movement of the sensor sleeve 54 about the sensor body 52. Thus, when the sensor plate moves left and right in the figure (see the horizontal arrow) the gap 222 is varied. Similarly, when the sensor plate moves upward and downward in the figure (see the vertical arrow) the gap 224 is varied. The key provided on the figure indicates that the lateral movement corresponds to the rotational displacement of the sensor sleeve 54 when a torque is applied to the well casing and the vertical movement corresponds to the longitudinal displacement of the sensor sleeve 54 when a tension is applied to the well casing. The dimensions of the components and the clearances or spacings between them are precisely determined to ensure that these first and second gaps 222, 224 vary in a predictable, consistent way.

The position of the sensor plate 220, with the notch disposed so that the variable first and second gaps 222 and 224 are approximately the same in this perspective, a net, median magnetic flux of a known amount, set up by the first and second rare earth magnets 202, 204, will exist in the core of the sensor coil 208 when it is energized by the 400 Hz square wave 192. This configuration corresponds to the reset or centered condition, after the reset operation and prior to applying the tension or torque to the well casing. As the sensor plate 220 moves left or right, or upward or downward from the median position shown, the gap at 222 or 224 will change, and so will the magnetic reluctance of the respective gap, thereby varying the magnetic flux in the core of the sensor coil 208 from the median value. As the sensor plate 220 moves to the right in the figure, most of the magnetic flux flows in the core of the inductor 208. Conversely, as the sensor plate 220 moves to the left in the figure, the flux in the core of the inductor 208 drops toward zero because the flux path, following the path of least reluctance, is set up in the first and second bar magnets 202, 204, the pole piece 206 and the sensor plate 220. Correspondingly, as the magnetic flux in the core of the sensor coil 208 varies, the inductance of the sensor coil 208 varies proportionately. This inductance varies in a linear and very sensitive way with the displacement of the well casing. In one embodiment, the variation of the inductance of the sensor coil 208 encompasses a range of approximately 10 to 22 millihenry as the displacement of the sensor sleeve 54 relative to the sensor body 52 varies from zero to 0.100 inch. It will be noted that the displacement in this embodiment actually is designed to vary within a range of +/−0.050 inch relative to a nominal "reset" displacement of 0.050 inch. The inductance variation is manifested in a corresponding change in the shape and amplitude of the peak portion of the 400 Hz square wave 192 that is monitored by the free point tool processor 166. The changes will be analyzed and described in conjunction with FIGS. 7A and B, 8A, B and C, and 9A, B and C following a description of the free point tool processor 166 in FIG. 6.

Figure 6:
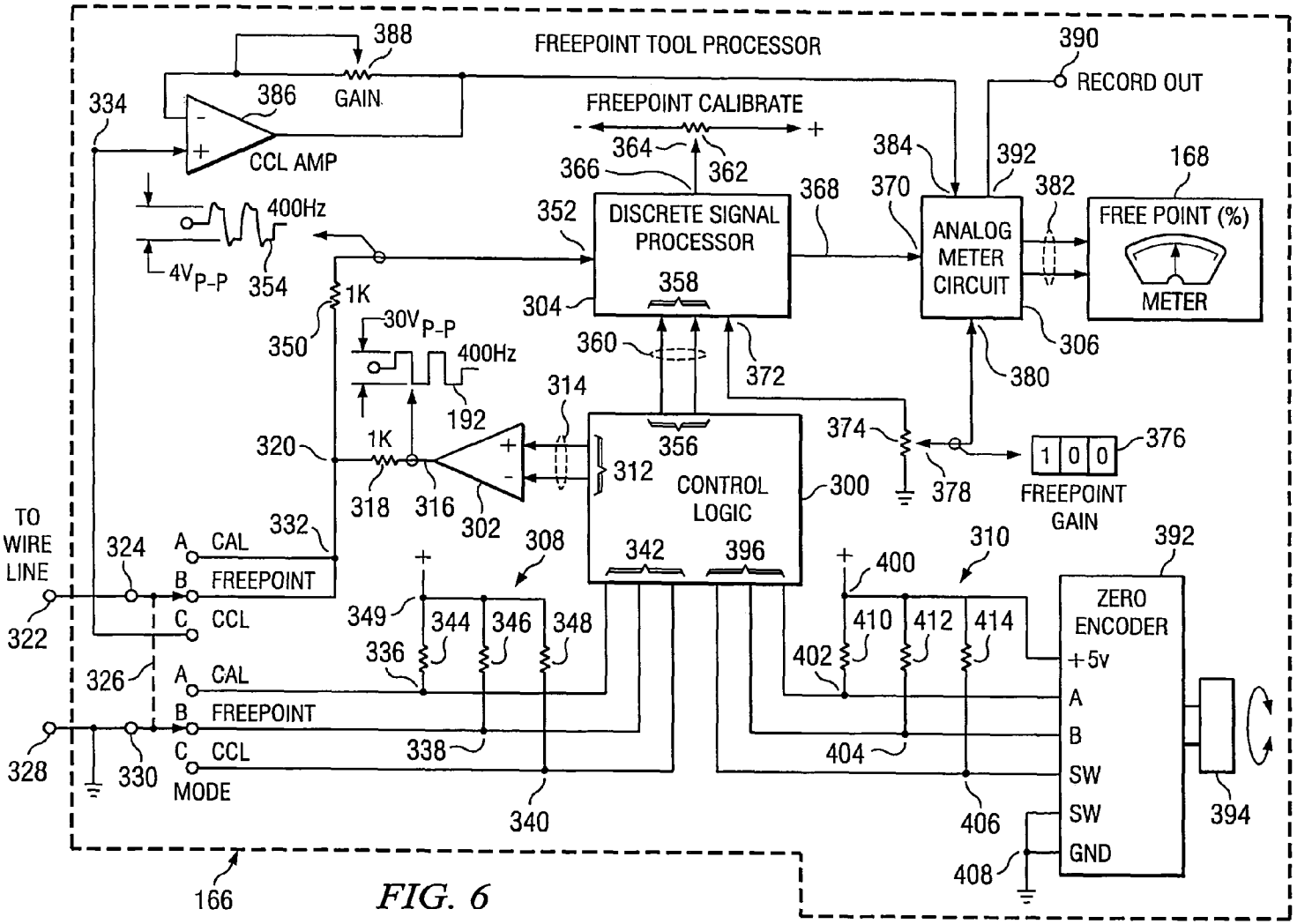
FIG. 6 illustrates a block diagram of one embodiment of a free point sensor processor for use with the free point tool of the present invention.

Referring to FIG. 6, there is illustrated a simplified block diagram of one embodiment of a free point tool processor 166 for use with the free point tool 10 of the present invention. The free point tool processor 166 (hereinafter FPT processor 166) is a processing instrument for use by well service personnel in operating the free point tool to obtain measurements for locating the free point of a stuck pipe. The processing instrument or FPT processor 166 includes several principal functional blocks including a control logic IC (integrated circuit) 300, a signal amplifier 302 for the square wave signal 192, a discrete signal processor 304, an analog meter circuit 306 coupled to a free point meter 168, a mode select network 308, and a ZERO encoder network 310. The control logic 300 is implemented in the illustrated embodiment using a type XCR3064XL customer programmable logic device (CPLD) manufactured by Xilinx, Inc. to implement control of the signal generating, measuring, calibration and control functions in the FPT processor 166. While, in a preferred embodiment, the functional blocks of the processing instrument or FPT processor 166 may be incorporated into a single, self-contained unit, it is not required that it be so constructed. In other embodiments it may be advantageous to provide one or more individual functional blocks in separate units.

The FPT processor 166 further includes a DPTT (double pole, three terminal) mode switch 326, having first 324 and second 330 wiper terminals connected to first (signal) 322 and second (ground) 328 input/output terminals. The mode switch 326 provides three output terminals, A, B and C, which correspond to the functions CALIBRATE, FREEPOINT, and CCL, respectively. In the CALIBRATE mode (A), the instrument is configured for calibrating its operating points. In the FREEPOINT mode (B), the instrument is configured for applying a square wave sensor signal to the free point tool and making measurements to locate the free point of the well casing. In the CCL mode (C), the instrument is configured for sensing the location of the casing collars as the free point tool is moved upward and downward within the well casing. The second wiper terminal 330 applies a ground connection to respective nodes 336, 338, and 340 of a mode control network 308, which nodes are connected to pull up resistors 344, 346, and 348 respectively tied to a positive DC supply voltage at a node 349. The nodes 336, 338, and 340 are further connected to control inputs 342 of the control logic IC 300. Thus, the mode switch 326 applies logic HI or LOW control signals to the control inputs of the control logic IC 300.

The control logic IC 300 in the illustrated embodiment includes a signal generator or square wave generating circuit that produces a 400 Hz, 30 Volt peak-to-peak square wave at an output 312 and couples it to the input of the signal amplifier 302 via the signal path 314. In other embodiments it may be preferable to implement the signal generator as a circuit separate from the control logic IC 300. The output of the signal amplifier 302 is coupled via the lead 316 through a 1K Ohm isolation resistor 318 to a node 320, which is coupled through a FREEPOINT terminal (B) and a first wiper terminal 324 of the mode switch 326 to an input/output terminal 322. It will be appreciated that the waveform amplitude that appears at the terminal 322 and the node 320 is reduced from the amplitude of the signal along lead 316 because of the voltage divider action of the isolation resistor 318, the resistance of the wire line to the free point tool and the resistance of the free point tool itself. Further, the shape of the waveform at node 320 will also be altered by the impedances of the sensor in the free point tool, as will be described in detail herein below.

The control logic IC 300 further includes a ZERO encoder control. Ground and DC voltage inputs from a resistor network 310 coupled through the ZERO encoder 392 are applied to encoding terminals 396 of the control logic IC 300. The +5V terminal of the ZERO encoder 392 is connected to a positive DC supply voltage at a node 400. Terminals A, B, and SW1 of the ZERO encoder 392 are connected to nodes 402, 404, and 406 respectively, which couple signals from the ZERO encoder 392 to respective control inputs 396 of the control logic IC 300. Each of the nodes 402, 404, and 406 is connected to the node 400 via respective pull up resistors 410, 412, and 414. The SW2 and ground terminals of the encoder 392 are connected to ground at a node 408. The ZERO encoder 392 is used to set the free point meter 168 to zero during the FREEPOINT mode. Further, the free point meter 168 may be automatically set to zero after at least one measurement has been made merely by pressing the knob 394.

A discrete signal processing circuit 304, also supplied with control signals from the control logic 300 along a bus 360 between a control port 356 of the control logic IC 300 and a corresponding input port 358 of the discrete signal processor 304, processes the return signal from the free point tool sensor in the well casing through a sample-and-hold circuit, a switched capacitor filter, a chopper-stabilized amplifier and other associated circuits to measure the changes in peak values of the returned 400 Hz. square wave. The sample and hold circuit receives the return signal and responds to the peak values of the 400 Hz. square wave pulse signal. The switched capacitor filter, which follows the sample and hold circuit in the signal processing path, removes noise and the effects of unrelated disturbances from the information contained in the peak portions of the 400 Hz. signal. Following the filter in the signal path, a chopper stabilized amplifier balances the circuit output and provides the correct signal level for further processing by a metering circuit.

The information about the displacement of the well casing during the application of tension or torque stress to the well casing is contained in the shape of the peak portion of the square wave signal that appears at—i.e., is returned to—the input 352 of the discrete signal processor 304. In order to properly process the information in the peak portions of the returned 400 Hz. square wave, the discrete signal processor 304 operates synchronously with the 400 Hz. square wave according to timing information provided via bus 360 from the control logic IC 300. The return signal 354 is coupled to the input 352 from the input terminal 322 of the FPT processor 166 via the signal side 324 of the mode switch 326, node 320, and a second 1 K Ohm isolation resistor 350. The wave form of the return signal 354 typically has a peak-to-peak voltage amplitude of between four and five volts. It will also be appreciated that the shape of the wave form 354 has been altered by the impedances of the wire line 18 and the sensor circuit.

The discrete signal processor 304 provides an output on a line 368 to an input 370 of a metering circuit 306. In the preferred embodiment the metering circuit 306 is implemented as an analog meter circuit 306, which processes the signal in a meter buffer circuit for display and couples it to the free point meter 168 along the signal link 382. A RECORD output 390 is provided from an output 392 of the analog meter circuit 306. The meter in the illustrated embodiment includes an analog scale because it provides an output display or indication as a continuous deflection of a meter needle or other indicator that corresponds with the displacement of a well casing when a tension or torque is applied to the well casing. This type of display is much easier to read and interpret at a distance or under actual oil field conditions. This is not to be considered a limitation, however, because other types of display may be adapted to serve the same purpose with little loss of function.

The discrete signal processor 304 further includes two adjustment circuits connected thereto. A FREE POINT CALIBRATE control is provided by a variable resistor 362 connected between a positive and negative DC supply voltage. A wiper terminal 364 of the variable resistor 362 couples a calibrating voltage from the wiper 364 to a calibration input 366 of the discrete signal processor 304. A FREE POINT GAIN control is provided by a variable resistor 374 connected between a gain control input 372 of the discrete signal processor 304 and ground. The wiper 378 of the variable resistor 374 is connected to an output 380 of the analog meter circuit 306 to provide a feedback signal therefrom to the discrete signal processor 304 via the variable resistor 374. The FREE POINT GAIN control includes a three digit readout 376 in the illustrative embodiment to indicate a relative gain setting from zero to 1000 that corresponds to the particular type of drill pipe being used. A gain setting of 1000 corresponds to an actual circuit gain of approximately ×10. A gain setting of 100 corresponds to an actual circuit gain of approximately×1, or unity. Drill collars are larger and heavier than the drill pipe itself, in some instances up to ten times as heavy. The calibrated measurement pull in such cases would stretch the drill pipe, not 3.50 inches, but 35 inches. This is not considered safe and is therefore not attempted. Different sizes of drill pipe, i.e., which vary in diameter, wall thickness, etc., are pulled at 30,000, 40,000, and 50,000 pounds of additional measurement pull. Then, using a chart, the pull and free point gain are selected to give 100% free readings in the drill pipe being measured if, in fact, it is free from being stuck in the well bore. For example, a conventional drill pipe may require a gain setting of 100, whereas a heavy weight drill collar may require a free point gain setting of 956. The FREE POINT CALIBRATE control 362 is adjusted during the calibration procedure, after the mode switch 326 is set to the CALIBRATE position (A) following reset and before a measurement is taken, so that the free point meter 168 indicates zero. The calibration procedure will be described further with FIG. 11 hereinafter.

In operation, the discrete signal processor 304 measures the peak amplitudes of the return signal 354 at predetermined time intervals and subtracts a DC component to yield a difference voltage that is proportional to the change in inductance of the sensor inductor (208 in FIG. 5). The change in inductance is proportional to the displacement of the well casing when a tension or torque is applied to the well casing. The resulting difference voltage is then applied to the free point meter 168 to indicate a percent free value between minus 100 percent and plus 100 percent. Plus 100 percent free corresponds to a 100% free pipe during a measurement when upward tension or right-hand torque is applied to the well casing. Minus 100 percent free corresponds to a 100% free pipe during a measurement when downward compression or left-hand torque is applied to the well casing. For example, in a typical calibration, 100 percent free corresponds to a longitudinal movement, of one of the drag springs relative to the other with tension applied, of 0.0175 inch for a typical pipe that weighs 12 pounds per foot and elongates by 3.50 inches per 1000 feet of length. It is helpful to recall that the sensor measures the relative displacement of the sensor sleeve 54 (attached to the lower drag spring 38) with respect to the sensor body 52 (attached to the upper drag spring 32). Similarly, when the same type of pipe or well casing is under a torque, 100 percent corresponds to a relative rotation of 1.80 degrees.

When the mode switch 326 is set to the CCL position (C) an input signal from the free point tool via the wire line is applied via node 334 to a CCL amplifier 386, which outputs the amplified signal to the analog meter circuit 306 at a second input 384 thereto. The gain of the CCL amplifier 386 is adjustable using the variable resistor 388. This mode is used when the free point tool is moved upward or downward within the well casing. The CCL amplifier 386 senses the presence of a casing collar and provides an output to the meter to cause deflection of the meter to nearly full scale and back, through several swings of the needle.

Figure 7A:
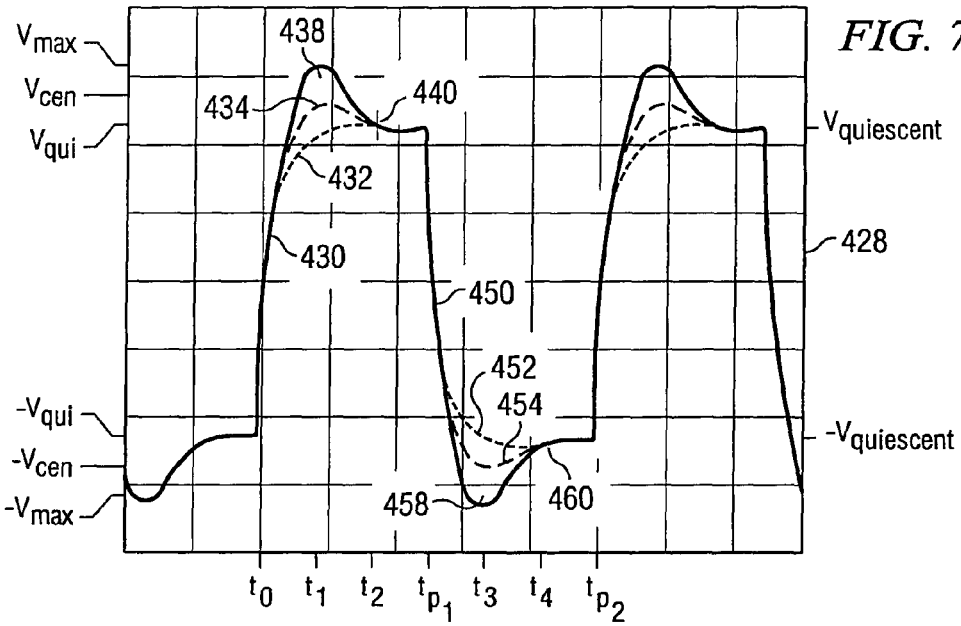
FIG. 7A illustrates a waveform of a sensor signal and several features thereof for analysis in the sensor processor of FIG. 6.

Referring to FIG. 7A, there is illustrated a waveform of a sensor signal and several features thereof for analysis in the sensor processor of FIG. 6. The waveform represents the return signal of a 400 Hz square wave applied to the sensor inductor via the wire line. The period of the square wave is 2500 microseconds, or approximately 500 microseconds (usec) per division in the display. The amplitude of the return signal (see FIG. 6, reference number 354 at the input 352 to the discrete signal processor 304) is typically approximately four-to-five Volts peak-to-peak; however, in the illustration of FIG. 7A, it is enlarged somewhat to about 6.5 Volts, i.e., one Volt per division, for clarity.

Several time values are indicated on the horizontal axis of FIG. 7A. Time t0 defines an origin corresponding to a zero crossing; t1 and t2 represent successive 400 usec intervals following t0, and tp1=1250 usec represents an end of the period of the first (positive) alternation of the 400 Hz signal. The time tp1 also represents the origin of the second (negative) alternation of the 400 Hz signal and tp2 represents the end of the second (negative) alternation, at tp2=2500 usec, corresponding to a full cycle of the 400 Hz signal wave form. The times t3 and t4 represent successive 400 usec intervals after tp2. Several voltage values are indicated on the vertical axis. An origin marks the center horizontal line along the left vertical axis. Peak values of the positive wave form are indicated by Vmax (occurring at t1) and Vqui (occurring at t2) for Vquiescent. Similarly, peak values of the negative wave form are indicated by −Vmax (at t3) and −Vqui (at t4) for −Vquiescent. Vmax and Vqui correspond to the maximum and quiescent values, respectively. The Vquiescent value is defined as the value at which the Vpeak value equals the value of the voltage for a purely resistive load.

The 400 Hz square wave output from the signal amplifier 302 at line 316 (see FIG. 6) has a peak-to-peak value of approximately 30 Volts and resembles a non-distorted square wave. However, the circuit connected to the output of the signal amplifier 302, not being purely resistive, includes reactance, both capacitive (in the wire line) and inductances (some in the wire line but mainly in the magnetic amplifier sensor circuit itself). The reactance result in overshoot as the signal approaches its peak value, but this overshoot is utilized to great advantage in the free point tool processor 166 of the present invention. Further, the resistance in the circuit loading the output of the signal amplifier reduce the amplitude of the signal from the 30 Volt level to approximately four to five Volts. Several aspects or attributes of importance of the wave form are identified in FIG. 7A, by way of defining terms useful in describing the wave forms of FIGS. 7B and 7C. The positive 430 and negative 450 swings of the wave form signal are indicated, along with the respective resistive components 432 and 452, which represent the wave form if no reactance were present. The values 434 and 454 represent median or center values (Vcen) of the wave form peak corresponding to the resetting or centering of the sensor sleeve 54 with respect to the sensor body 52 in preparation for a measurement. The values 438 and 458 represent Vmax and −Vmax, respectively. The values 440 and 460 represent quiescent values, Vqui and −Vqui respectively, in which the amplitude of the wave form has settled to approximately the same value as the wave form would have if the load were purely resistive.

Figure 7B:
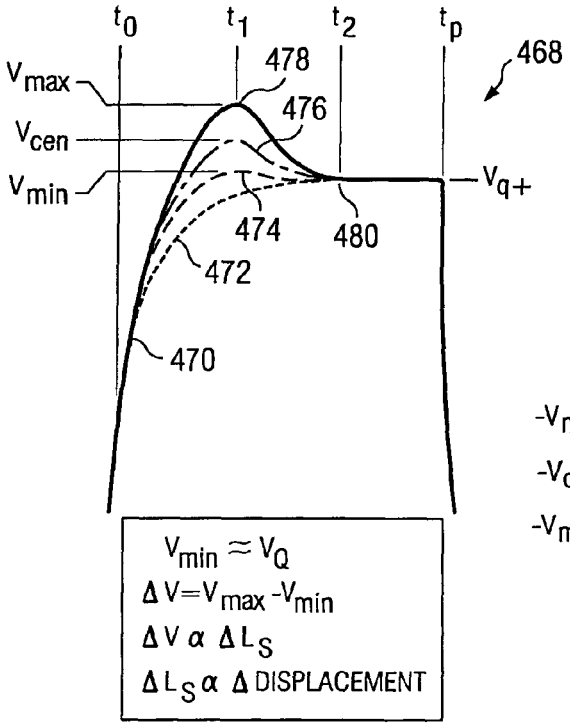
FIG. 7B illustrates an enlarged portion of the positive waveform of a sensor signal corresponding to sensor measurements performed by the sensor processor of FIG. 6.

FIG. 7B illustrates an enlarged portion of the positive waveform of a sensor signal corresponding to sensor measurements performed by the FPT processor 166 of FIG. 6 when tension in the drill pipe or well casing is being measured. It is essentially the same as the positive portion of the wave form shown in FIG. 7A, except for an additional value, Vmin. Thus, the rising edge 470 becomes the signal 472 for a purely resistive load; it becomes the signal 474 for a minimum reactive component Vmin corresponding to the minimum sensor inductance value when the sensor plate moves so that the gap 224 in FIG. 5 is widest (maximum tension or stretch); it becomes the signal 476 for a median reactive component Vcen corresponding to the median or reset inductance value when the sensor sleeve 54 is centered with respect to the sensor body; and it becomes the signal 478 for a maximum reactive component Vmax corresponding to the maximum sensor inductance value when the sensor plate moves so that the gap 224 in FIG. 5 is smallest (minimum tension or compression).

It will be appreciated that the value Vmin closely approximates the value +Vquiescent (Vq+ in FIG. 7B). This provides a simple and accurate way for the FPT processor 166 to measure the change in inductance, simply by measuring Vmax at t1 (400 usec after to) and measuring Vq+ at t2 (400 usec or more after t1), and then subtracting Vq+ from Vmax to get delta V. Delta V, which is approximately 0.5 Volt in the example illustrated in FIG. 7A, is directly and linearly proportional to the change in inductance as the well casing is stretched or twisted. The delta V is converted to a percent free value by the FPT processor 166 and indicated on the free point meter 168 of FIGS. 5 and 6.

Figure 7C:
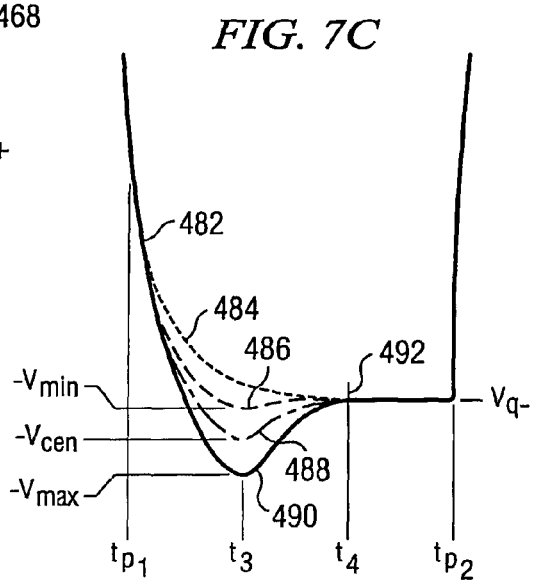
FIG. 7C illustrates an enlarged portion of the negative waveform of a sensor signal corresponding to sensor measurements performed by the sensor processor of FIG. 6.

Referring to FIG. 7C, there is illustrated an enlarged portion of the negative waveform of a sensor signal corresponding to sensor measurements performed by the FPT processor 166 of FIG. 6 when torque (right hand or left hand twisting) applied to the drill pipe or well casing is being measured. FIG. 7C provides the same information as FIG. 7B, except it references the negative alternation of the square wave sensor signal that is active when torque in the drill pipe or well casing is being measured. It is essentially the same as the negative portion of the wave form shown in FIG. 7A, except for an additional value, −Vmin. Thus, the falling edge 482 of the positive alternation in FIG. 7B, (the rising edge of the negative alternation 482) becomes the signal 484 for a purely resistive load; it becomes the signal 486 for a minimum reactive component −Vmin corresponding to the minimum sensor inductance value when the sensor plate moves so that the gap 222 in FIG. 5 is widest (maximum left hand torque); it becomes the signal 488 for a median reactive component −Vcen corresponding to the median or reset inductance value when the sensor sleeve 54 is centered with respect to the sensor body and no torque is applied; and it becomes the signal 490 for a maximum reactive component Vmax corresponding to the maximum sensor inductance value when the sensor plate moves so that the gap 222 in FIG. 5 is smallest (maximum right hand torque).

To summarize the concept of the operation of the FPT processor 166, for both cases of tension and torque, Vmin is set equal to Vquiescent. Then, delta V is set equal to Vmax less Vmin. Delta V is directly proportional to the change in the sensor coil inductance, which, in turn is directly proportional to the displacement of the well casing or drill pipe being stretched or twisted to locate the free point. As mentioned hereinabove, in calibration of the free point tool, 100 percent free corresponds to a longitudinal movement, of one of the drag springs relative to the other with a standard known tension applied, of 0.0175 inch (0.0035 inch/foot×5.0 feet between the drag springs) for a typical pipe that weighs 12 pounds per foot and elongates by 3.50 inches per 1000 feet of length. Recall that the sensor measures the relative displacement of the sensor sleeve 54 (attached to the lower drag spring 38) with respect to the sensor body 52 (attached to the upper drag spring 32), which is limited to +/−0.050 inch in either direction. Thus, while the 100 percent point is correlated with a movement of the well casing of 0.0175 inch in the above example, the 0.050 inch range built into the sensor correlates to a meter indication of approximately 285 percent free. This is an example of the extra range built into the sensor that is possible because of its extraordinary sensitivity and linearity. To complete the correlation, a delta V of approximately +/−0.5 Volt, which correlates with a sensor inductance of, for example, 16+/−6 millihenry of inductance, also correlates with the +/−0.050 inch rotational or longitudinal movement of the sensor sleeve. Similarly, when the drill pipe or well casing is under a torque, 100 percent free corresponds to a relative rotation of 1.80 degrees.

Figure 8A:
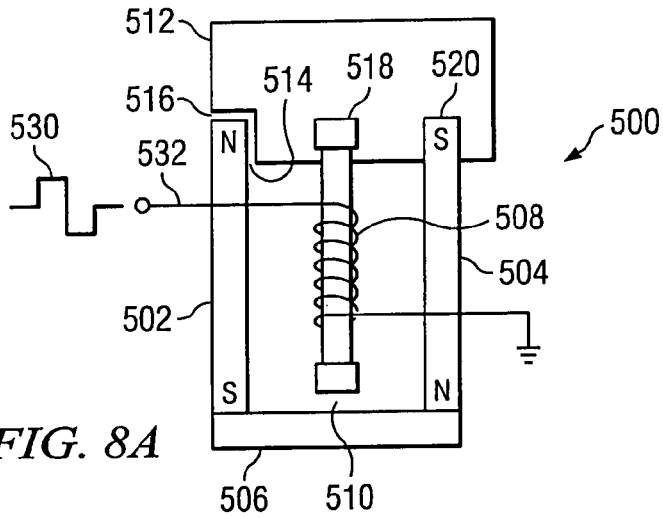
FIG. 8A illustrates a pictorial diagram of the sensor assembly of FIGS. 2A, 2B and 3 at an initial condition of the sensor assembly after the free point tool is reset.

Referring to FIG. 8A, there is illustrated a pictorial diagram of the sensor assembly of FIGS. 2A, 2B and 3 at an initial condition of the sensor assembly after the free point tool is reset. The view in FIG. 8A essentially duplicates the view of the free point sensor 172 in FIG. 5, but in somewhat simplified form. The magnetic amplifier sensor assembly 500 includes first and second rare earth bar magnets 502, 504, a soft iron pole piece 506, a sensor coil 508, and a movable sensor plate 512. A first gap 510 is provided between the first end of the sensor coil 508 and the pole piece 506. A second gap 518 is provided between the opposite, second end of the sensor coil 508 and the sensor plate 512. A third gap 520 is provided between the south pole of the second bar magnet 504 and the sensor plate 512. The second and third gaps 518, 520 remain constant during operation of the sensor assembly 500. In the position shown, corresponding to the reset or median (centered) configuration of the sensor assembly 500, the sensor plate 512 forms a first variable gap 514 with the north pole of the first bar magnet 502 and a second variable gap 516 with the north pole of the first bar magnet 502. The sensor signal 530 is applied from the wire line (not shown) via the sensor wire 532 to the sensor coil 508. As the sensor plate 512 moves relative to the first bar magnet 502, the variable gaps 514 or 516 vary the reluctance in the magnetic amplifier circuit and cause a corresponding variation in the inductance of the sensor coil 508.

Figure 8B:
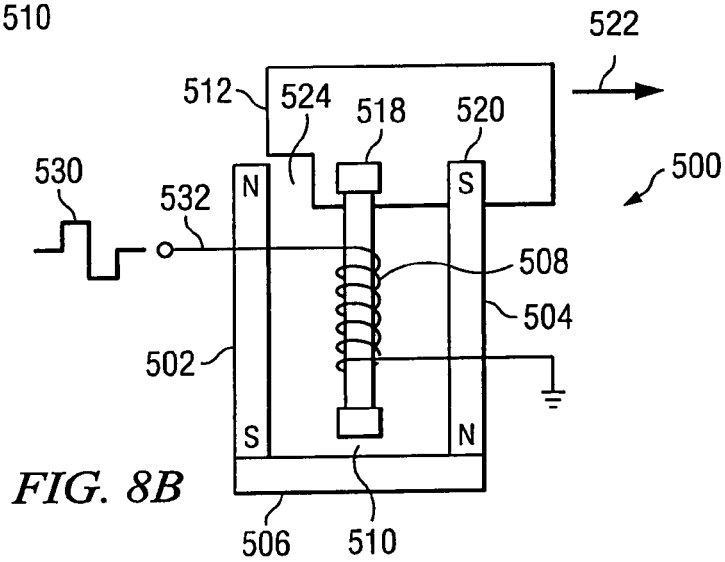
FIG. 8B illustrates the sensor assembly of FIG. 8A at a displacement of the well casing upon application of a right hand torque.
Figure 8C:
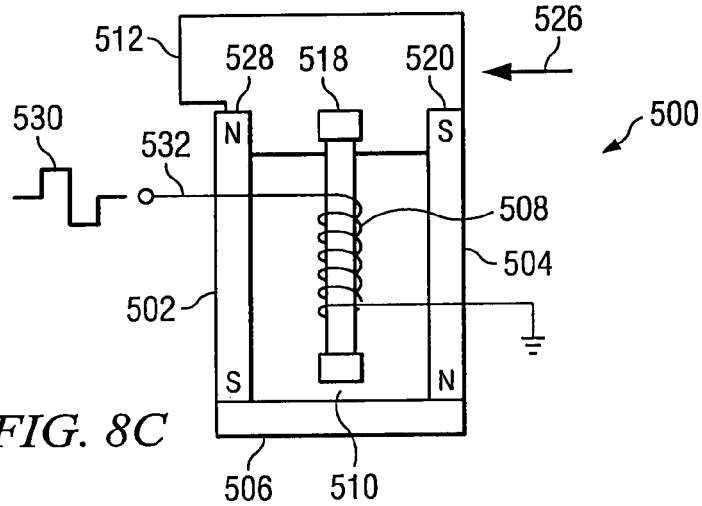
FIG. 8C illustrates the sensor assembly of FIG. 8A at a displacement of the well casing upon application of a left hand torque.

FIGS. 8B and 8C are very similar to FIG. 8A, except they illustrate the change in position of the sensor plate 512 as the sensor sleeve 54 (and the embedded sensor plate 512) rotate relative to the sensor body 52. Thus, FIG. 8B illustrates the sensor assembly of FIG. 8A at a displacement of the well casing upon application of a right hand torque, and FIG. 8C illustrates the sensor assembly of FIG. 8A at a displacement of the well casing upon application of a left hand torque. In FIG. 8B, the sensor plate 54 rotates, moving in the direction 522 in the figure and increasing the variable gap 524. In this configuration of the illustrative embodiment, the magnetic flux set up in the sensor inductor 508 increases, to a maximum of approximately 50 Gauss, causing its inductance to increase to a maximum of approximately 22 milliHenrys, and the peak value of the negative alternation of the sensor signal to increase toward −Vmax. In FIG. 8C, the sensor plate 54 rotates, moving in the direction 526 in the figure and decreasing the variable gap 524 because the flux in the sensor coil 508 is diverted to the first bar magnet 502. In this configuration, the magnetic flux set up in the sensor inductor 508 decreases to a minimum of approximately zero Gauss, causing its inductance to decrease to a minimum of approximately 10 milliHenrys, and the peak value of the negative alternation of the sensor signal to decrease toward −Vmin.

Figure 9A:
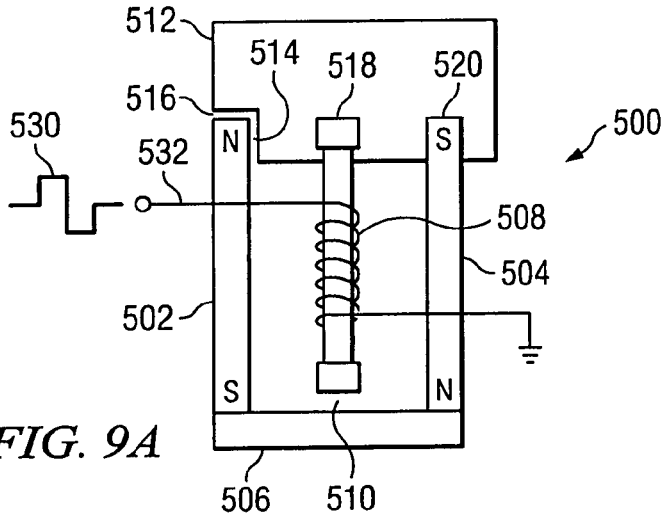
FIG. 9A illustrates a pictorial diagram of the sensor assembly of FIGS. 2A, 2B and 3 at an initial condition of the sensor assembly after the free point tool is reset.

Referring to FIG. 9A, there is illustrated a pictorial diagram of the sensor assembly of FIGS. 2A, 2B and 3 at an initial condition of the sensor assembly after the free point tool is reset. The view in FIG. 9A, exactly like FIG. 8A, essentially duplicates the view of the free point sensor 172 in FIG. 5, but in somewhat simplified form. The magnetic amplifier sensor assembly 500 includes first and second rare earth bar magnets 502, 504, a soft iron pole piece 506, a sensor coil 508, and a movable sensor plate 512. A first gap 510 is provided between the first end of the sensor coil 508 and the pole piece 506. A second gap 518 is provided between the opposite, second end of the sensor coil 508 and the sensor plate 512. A third gap 520 is provided between the south pole of the second bar magnet 504 and the sensor plate 512. The second and third gaps 518, 520 remain constant during operation of the sensor assembly 500. In the position shown, corresponding to the reset or median (centered) configuration of the sensor assembly 500, the sensor plate 512 forms a first variable gap 514 with the north pole of the first bar magnet 502 and a second variable gap 516 with the north pole of the first bar magnet 502. The sensor signal 530 is applied from the wire line (not shown) via the sensor wire 532 to the sensor coil 508. As the sensor plate 512 moves relative to the first bar magnet 502, the variable gaps 514 or 516 vary the reluctance in the magnetic amplifier circuit and cause a corresponding variation in the inductance of the sensor coil 508.

Figure 9B:
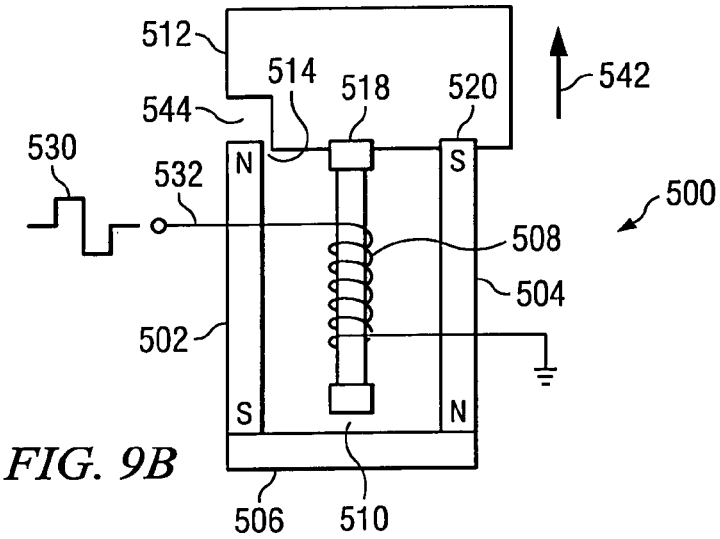
FIG. 9B illustrates the sensor assembly of FIG. 9A at a displacement of the well casing upon application of an upward tension or stretch.
Figure 9C:
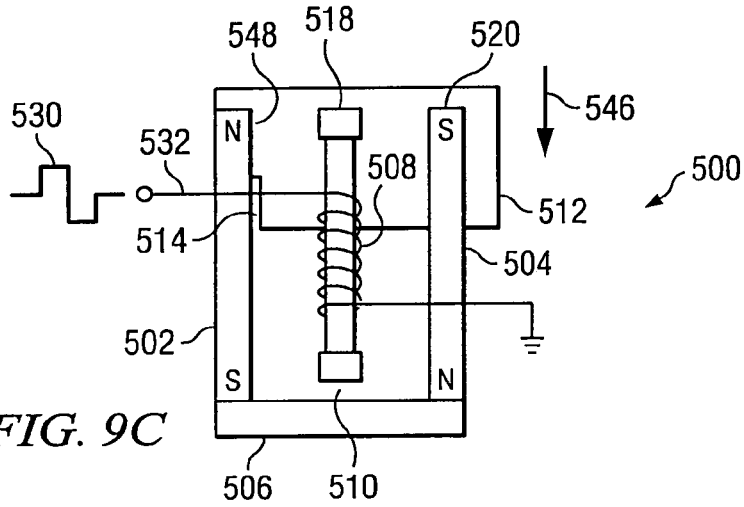
FIG. 9C illustrates the sensor assembly of FIG. 9A at a displacement of the well casing upon application of a downward compression or relaxation of a stretch.

FIGS. 9B and 9C are very similar to FIG. 9A, except they illustrate the change in position of the sensor plate 512 as the sensor sleeve 54 (and the embedded sensor plate 512) move longitudinally relative to the sensor body 52. Thus, FIG. 9B illustrates the sensor assembly of FIG. 9A at a displacement of the well casing upon application of a downward tension or compression, and FIG. 9C illustrates the sensor assembly of FIG. 9A at a displacement of the well casing upon application of a upward tension. In FIG. 9B, the sensor plate 54 moves in the direction 542 in the figure, increasing the variable gap 544. In this configuration of the illustrative embodiment, the magnetic flux set up in the sensor inductor 508 increases to a maximum of approximately 50 Gauss because more of the magnetic flux in the bar magnet 502 is diverted to the sensor coil 508, causing its inductance to increase to a maximum of approximately 22 milliHenrys, and the peak value of the positive alternation of the sensor signal to increase toward Vmax. In FIG. 9C, the sensor plate 54 moves in the direction 546 in the figure, decreasing the variable gap 544 because more of the flux in the sensor coil 508 is diverted to the first bar magnet 502. In this configuration, the magnetic flux set up in the sensor inductor 508 decreases to a minimum of approximately zero Gauss, causing its inductance to decrease to a minimum of approximately 10 milliHenrys, and the peak value of the negative alternation of the sensor signal to decrease toward Vmin.

Figure 10A:
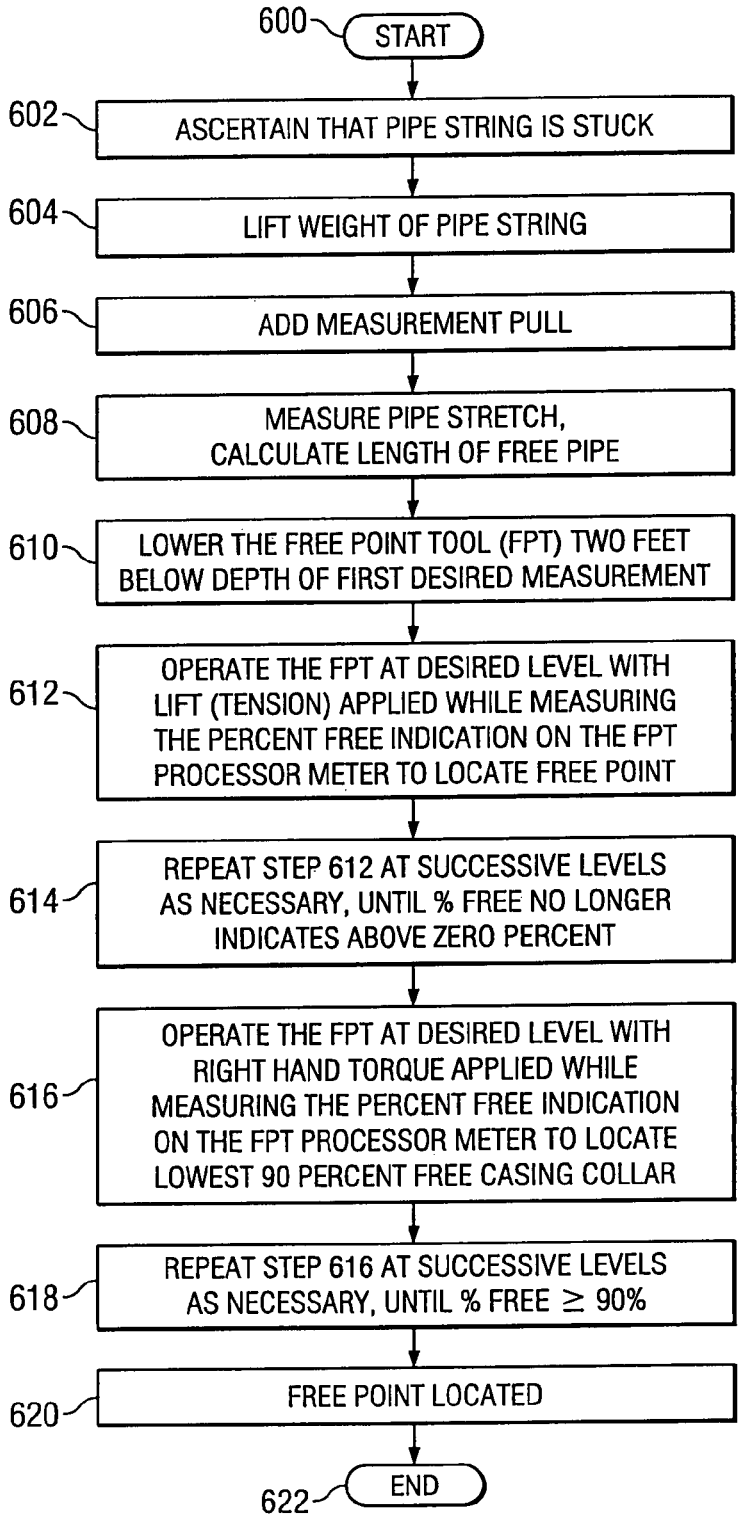
FIG. 10A illustrates a method of using a free point tool to locate the free point of a stuck pipe according to the disclosed embodiment.

Referring to FIG. 10A, there is illustrated flow chart for a method of using a free point tool to locate the free point of a stuck pipe according to the disclosed embodiment. In this description, the terms "well casing," "drill pipe," and "pipe string" will be used interchangeably. Further, it should be noted that the free point tool, in locating the stuck point in the pipe string or the well casing also determines the "free" point in the pipe string, which is usually construed to mean the lowest point in the pipe string where the pipe is not stuck, i.e., free in the well bore. The free point tool actually performs two functions: locating the stuck point, and then locating the lowest casing collar that is free, i.e., just above the stuck point. When this casing collar is located, operations to loosen that casing collar and remove the pipe string above that point can proceed, followed by the operations to loosen the stuck pipe string and resume the drilling operations.

Beginning from a start block 600, the process begins at step 602 to ascertain that a drill pipe string or well casing is indeed stuck in the bore of the well being dug. In the following step 604, a predetermined lift weight corresponding to the weight of the drill pipe above the measurement location (e.g., length of the pipe, in feet, ×the weight per foot+the weight of the drill collars in that length of pipe=the Weight), and, in step 606, the "measurement pull," based on the cross section of the drill pipe, is applied to the pipe string to stretch the drill pipe string by a known amount. The measurement pull may be determined using the formula: Pull=2208.5×weight-per-foot for the particular drill pipe. Thus, for a commonly used drill pipe of 12 lb./ft., the additional measurement pull applied would be approximately 26,500 lb. For this particular pipe, this amount of pull would yield a stretch of 3.5 inches per 1000 feet, or 0.0175 inch in the five foot section of the drill pipe between the drag springs of the free point tool, as would be detected by the sensor.

In the next step 608, the amount of pipe stretch is measured at the surface and the length of the free pipe calculated therefrom. For example, divide the amount of stretch in inches by 3.50 to get the length of the free pipe in thousands of feet. If the amount of stretch occurring in the pipe string of this example under the predetermined pull was measured to be 10.5 inches, then the length of the "free" pipe in the pipe string above the stuck point would be: (10.5 divided by 3.5)× 1000 feet=3000 feet. In step 610, lower the free point tool (FPT) two feet below the depth of the first desired measurement, and then operate the FPT at the desired level in step 612 with a lift (tension) applied to locate the free point, while measuring the percent free indication on the FPT processor meter 168. Step 612 is repeated in step 614 at successive levels as necessary, until the percent free no longer indicates above zero percent (0%). Next, in step 616, operate the FPT at the desired level with a right hand torque applied to the drill pipe or well casing, while measuring the percent free indication on the FPT processor meter 168, to locate the lowest 90% free casing collar. Repeat step 616 as necessary in step 618 at successive levels, until the percent free is greater than or equal to ninety percent (90%). When the correct free point reading is obtained, the free point is located as in step 620. The casing collar so located is thus identified as the collar to receive a string shot for loosening the "free" pipe string above the stuck point and the removal of the free pipe string so that the operations to remove the stuck pipe can commence. The process to locate the free point ends at block 622.

Figure 10B:
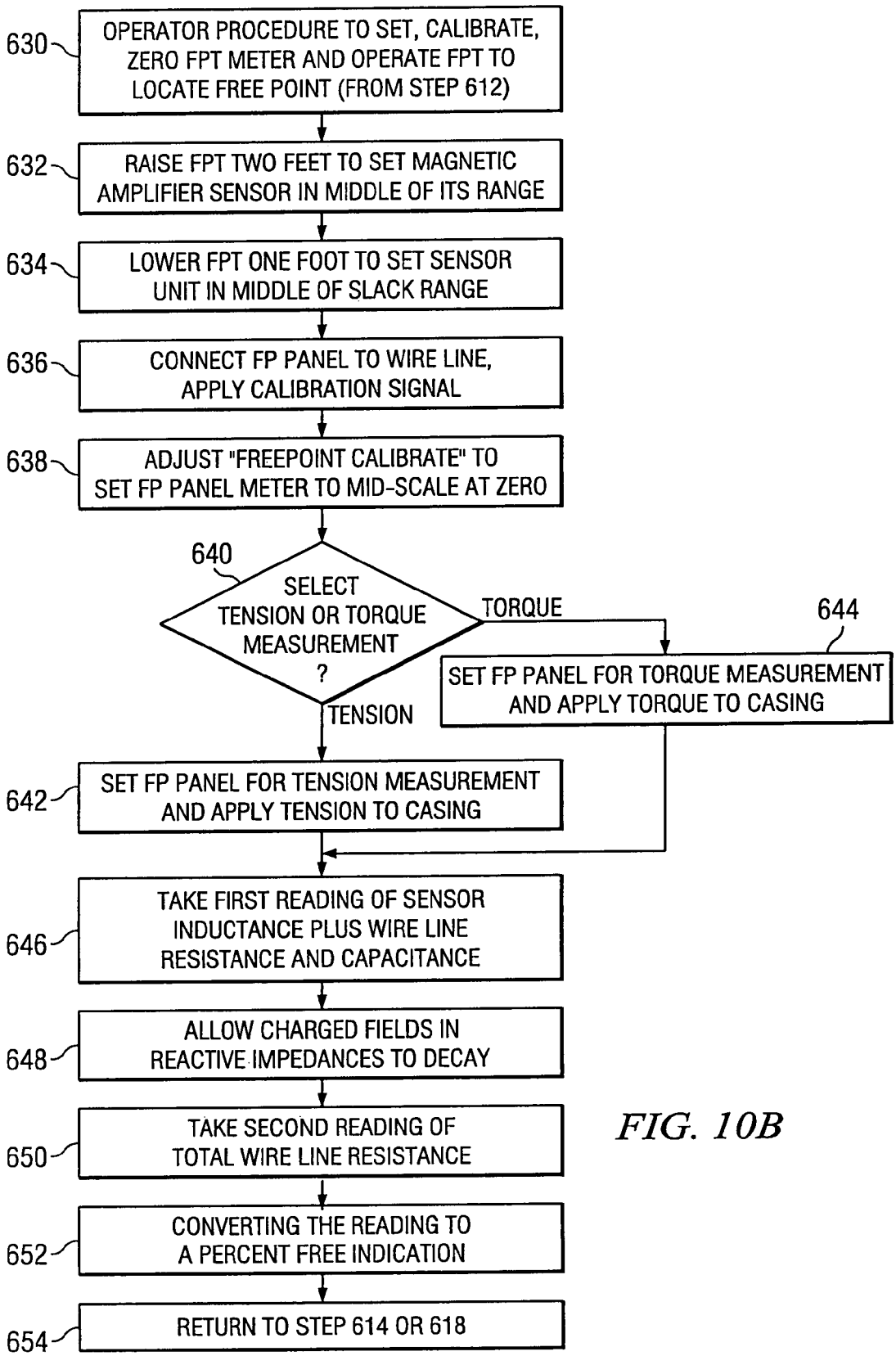
FIG. 10B illustrates a method of operating the free point tool during the method of FIG. 10A.

Referring to FIG. 10B, there is illustrated a flow chart for a method of operating the free point tool during step 612 of the method of FIG. 10A. The process begins in step 630 with an operator procedure to set, calibrate, and zero the FPT meter and operate the FPT to locate the free point. In step, 632, the operator raises the FPT two feet to set the low mass magnetic amplifier sensor in the sensor unit of the FPT to the center of its range. Then, in step 634, the FPT is lowered one foot to set the sensor unit in the center of the slack range built into the free point tool. With the sensor thus set at a known, repeatable operating point, in step 636 the FP panel, i.e., the free point tool processor instrument, is connected to the wire line and a calibration signal generated in the free point tool processor 166 is coupled thereto. Next, in step 638, the operator adjusts the FREEPOINT CALIBRATE control to set the FPT percent free meter 168 (i.e., the "freepoint" meter 168) to mid-scale at zero percent. A selection is made in step 640 as to whether to apply a tension (lift) or torque (twist) for the measurement to be made. If a tension measurement is selected, the free point panel on the FPT processor is set for a tension measurement and a lifting force is applied to the well casing in step 642. On the other hand, if a torque measurement is selected, the free point panel on the instrument is set for a torque measurement and a twisting force is applied to the well casing in step 644.

The procedure continues to step 646, wherein the FPT processor 166 takes the first reading of the effect of the sensor inductance plus the wire line resistance and capacitance, i.e., the complex impedance, on the square wave signal returned to the FPT processor 166. Then, in step 648, the FPT processor 166 delays approximately 400 microseconds (usec) to allow the charged fields in the reactive impedances to decay, leaving the resistive component to provide the basis for the percent free reading, as will be described further herein below. In the following step 650, the FPT processor 166 takes the second reading of the wire line impedance, now almost entirely resistive. Next, the procedure, in step 652 converts the second reading to a percent free indication for display on the freepoint meter 168 on the FPT processor 166. Step 654 returns the process to step 614 or 618 of the process described in FIG. 10A hereinabove to continue the procedure to locate the stuck point of the well casing or pipe string.

Figure 11:
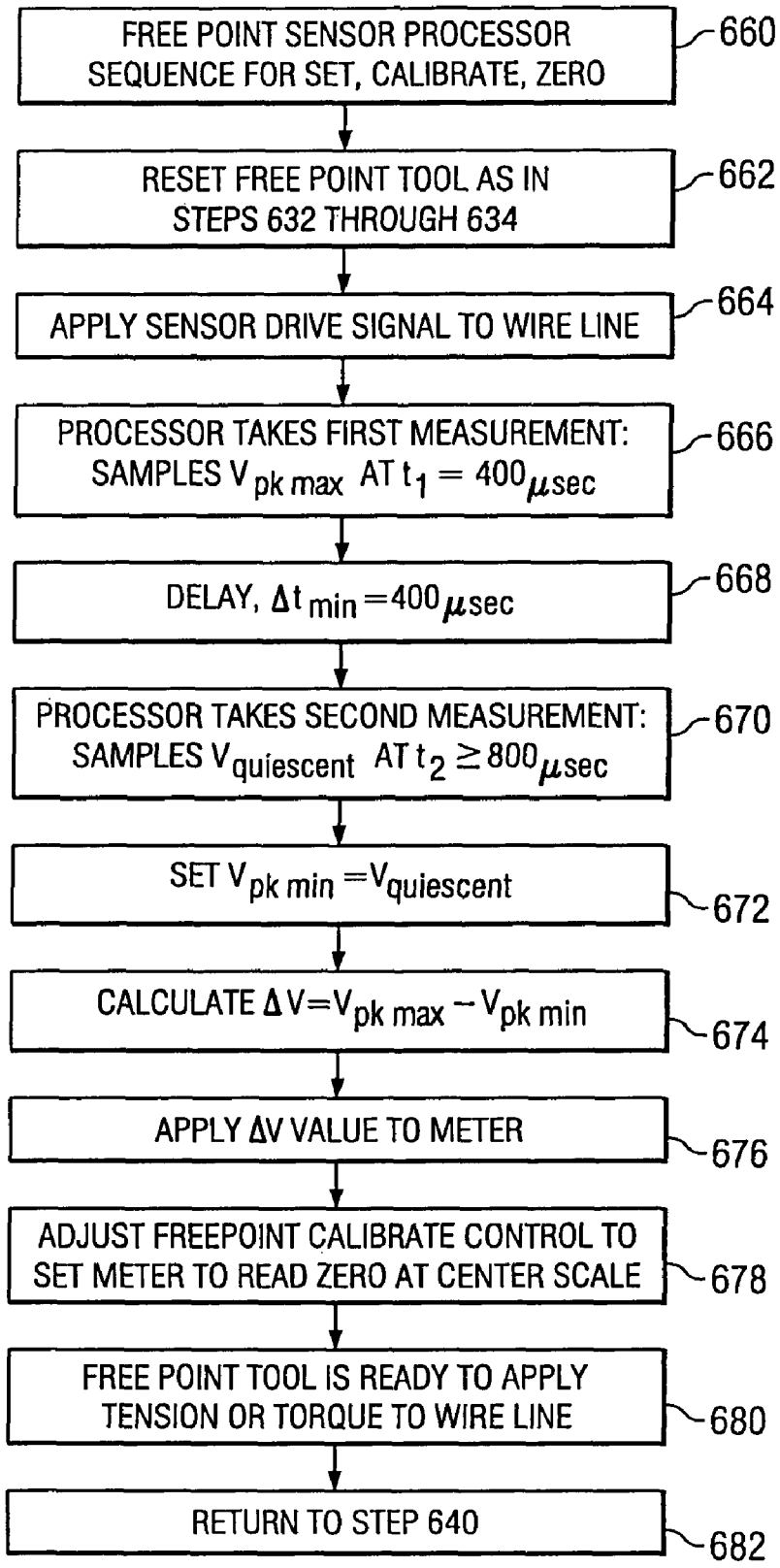
FIG. 11 illustrates a flow chart of a sequence of operations of the sensor processor of FIG. 6 when performing a measurement of displacement of the well casing.

Referring to FIG. 11, there is illustrated a flow chart detailing the sequence of operations of the sensor processor of FIG. 6 when performing the measurements of the displacement of the well casing described in steps 646 to 650 of FIG. 10A. As preliminary steps performed in the process described for FIGS. 10A and 10B, the FPT processor sequence for set, calibrate, and zero is performed in step 660, followed by the reset of the FPT as in steps 632 through 634 in FIG. 10B. Then, the sensor drive signal, the 400 Hz square wave signal, is applied to the wire line in step 664. The first measurement, corresponding to the maximum inductance of the sensor coil in the sensor body 52, is taken in step 666. At this point, the FPT processor samples the value of Vpk max (shortened to Vmax in FIGS. 7A, 7B, and 7C) at t1=400 usec. after the origin (at t0 or tp2 in FIG. 7A) corresponding to the rising edge of the wave form. Next, at step 668, the FPT processor delays a period delta tmin=400 usec. to the time t2, at approximately 800 usec. after t0. At time t2, the second measurement is taken in step 670, sampling the value of Vquiescent. Vquiescent is the value of the peak voltage that remains after the reactive components of the complex impedance of the wire line and sensor combination have decayed to zero, leaving the resistive component and the voltage impressed across it.

In step 672, the FPT processor sets Vpk min (shortened to Vmin in FIGS. 7A, 7B, and 7C) equal to Vquiescent, representing to a close approximation the minimum value of the peak voltage corresponding to the minimum inductance of the sensor coil in the sensor body 52. Then, in step 674, the delta V=Vp max−Vpk min is calculated. This value is scaled in the analog meter circuit (reference number 306 in FIG. 6) and applied in step 676 to the percent free meter 168 in the FPT processor 166 of FIG. 6. Next, in step 678 the operator adjusts the FREE POINT CALIBRATE control to set the percent free meter to zero at the center of the meter scale, corresponding to zero percent (0%) free. Step 680 notes that the free point tool is ready—i.e., set, calibrated and zeroed— awaiting the application of a tension or torque to the drill pipe or well casing, and the procedure returns to step 640 in FIG. 10B.

To summarize, a free point tool is disclosed comprising an elongated main shaft assembly for being suspended within a well casing at a lower end of a wire line cable and a low mass sensor assembly coaxially disposed over the elongated main shaft. The low mass sensor assembly is adapted to slide freely along the elongated main shaft and to be supported within the well casing by first and second drag spring centralizers coupled respectively to upper and lower ends of the low mass tubular sensor assembly. The first and second drag spring centralizers support only themselves and the low mass sensor assembly when the free point tool is positioned for measuring. The ratio of the drag spring capacity to the actual weight supported by the first and second drag spring centralizers exceeds approximately four to one. The low mass sensor assembly further includes a magnetic amplifier sensor. The magnetic amplifier sensor is enclosed within a sensor body and configured to sense well casing displacement through the wall of the pressure capsule formed by the sensor body. The pressure capsule contains no oil or semiconductors. The free point tool includes a built in slack range and a reset mechanism that restores the low mass sensor assembly to a reset condition in preparation for both tension and torque measurements in a single operation. The free point tool also includes a casing collar locator (CCL) having no semiconductors that is operable up to temperatures of 550 degrees Fahrenheit.

While the invention has been shown in only one of its forms, it is not thus limited but is susceptible to various changes and modifications without departing from the spirit thereof, as will be readily appreciated to persons skilled in the art.

What is claimed is:

1. A low mass sensor assembly for a well casing measurement tool, comprising:

a magnetic amplifier assembly having a first part and a second part;

a sensor body having a tubular shape, wherein the first part of the magnetic amplifier assembly is disposed proximate and within an outer surface of a first portion of the sensor body, said first part comprising first and second cylindrical magnets oriented parallel to each other and a sensor coil configured as a cylindrical inductor and disposed between and parallel with said first and second magnets and a pole piece disposed in contact with respective first ends of said magnets; and a sensor sleeve having a tubular shape and configured for concentrically and freely receiving the sensor body therewithin, wherein the second part of the magnetic amplifier assembly comprises a magnetic sensor plate portion of the sensor sleeve in juxtaposition with the first portion of the sensor body.

2. The apparatus of claim 1, wherein the sensor body further includes an axial bore for freely and slidingly receiving an elongated main shaft of the measurement tool therethrough.

3. The apparatus of claim 1, wherein the first part of the magnetic amplifier assembly comprises:

a fixed, soft iron pole piece in contact with and providing magnetic coupling between respective first ends of the first and second magnets;

wherein the cylindrical inductor and first and second cylindrical magnets, embedded within the sensor body, and disposed parallel to a longitudinal axis of the sensor body are positioned such that second respective ends of the cylindrical inductor and first and second magnets are proximate the first portion of the sensor sleeve according to a predetermined relationship.

4. The apparatus of claim 1, wherein the second part of the magnetic amplifier assembly comprises:

a magnetic sensor plate portion forming the first portion of the sensor sleeve and functioning as a movable pole piece displaced by a predetermined variable gap from at least one of the second ends of the cylindrical inductor and first and second magnets embedded within the sensor body, thereby providing for varying the inductance of the cylindrical inductor in proportion to displacement of the sensor sleeve caused by tension or torque applied to the sensor sleeve during a measurement.

5. The apparatus of claim 4, wherein the magnetic sensor plate portion is fabricated of a magnetic material having a mu value of at least six.

6. The apparatus of claim 1, wherein the sensor sleeve is configured to move with zero force longitudinally and rotationally, within a limited, predetermined range with respect to a defined reset position, during a measurement.

7. The apparatus of claim 1, wherein the sensor body and the sensor sleeve are fabricated of a non-magnetic material.

8. The apparatus of claim 1, wherein the magnetic amplifier assembly provides a voltage output linearly proportional to a displacement of the sensor sleeve when a tension or torque is applied to the sensor sleeve above a point of measurement in a well casing.

9. The apparatus of claim 1, wherein the low mass sensor assembly is configured for high resistance to mechanical shock, elevated temperatures and pressures, and exposure to corrosive materials within the well casing without requiring the use of oil-filled, high pressure enclosures.

* * * * *